US007283115B2

(12) United States Patent
Morii

(10) Patent No.: US 7,283,115 B2
(45) Date of Patent: Oct. 16, 2007

(54) DISPLAY DEVICE, CONTROL DEVICE OF DISPLAY DRIVE CIRCUIT, AND DRIVING METHOD OF DISPLAY DEVICE

(75) Inventor: Hideki Morii, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 436 days.

(21) Appl. No.: 10/648,438

(22) Filed: Aug. 27, 2003

(65) Prior Publication Data

US 2004/0155851 A1 Aug. 12, 2004

(30) Foreign Application Priority Data

Aug. 27, 2002 (JP) ..... 2002-246781

(51) Int. Cl.
*G09G 3/36* (2006.01)

(52) U.S. Cl. ..... 345/100; 345/99

(58) Field of Classification Search ..... 345/87, 345/98–100, 204

See application file for complete search history.

(56) References Cited

U.S. PATENT DOCUMENTS 5,867,139 A 2/1999 Tanaka et al. ..... 345/92
6,812,908 B2 * 11/2004 Lim ..... 345/87
6,891,521 B2 * 5/2005 Park et al. ..... 345/87
2001/0050678 A1 12/2001 Nishikubo et al. ..... 345/204
2002/0033787 A1 * 3/2002 Park et al. ..... 345/87
2004/0021650 A1 * 2/2004 Yamashita et al. ..... 345/204

FOREIGN PATENT DOCUMENTS

JP 08-043793 2/1996

* cited by examiner

*Primary Examiner*—Amr A. Awad
*Assistant Examiner*—Tom V Sheng
(74) *Attorney, Agent, or Firm*—Harness, Dickey & Pierce, P.L.C.

(57) ABSTRACT

In a display device of the present invention, during a period until the start of outputting display data from a source driver, a timing control ASIC generates a gate start pulse signal GSP and a first pulse CK1 of a gate clock signal GCK, with reference to the timing of inputting a data enable signal ENAB. The signals having been generated are supplied to the gate driver, so that a dummy line G0 is driven.

11 Claims, 30 Drawing Sheets

FIG. 26 (a) (PRIOR ART)
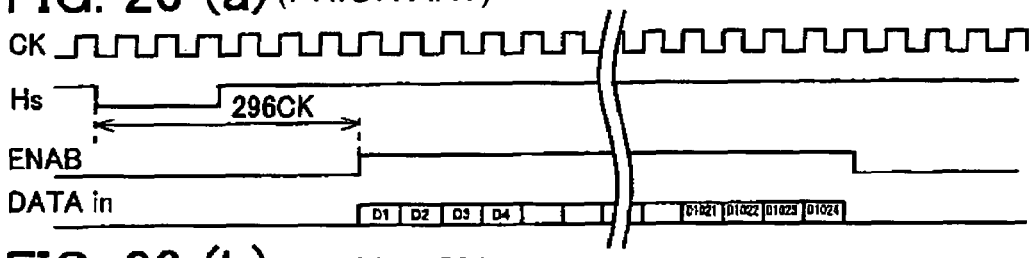
FIG. 26 (b) (PRIOR ART)
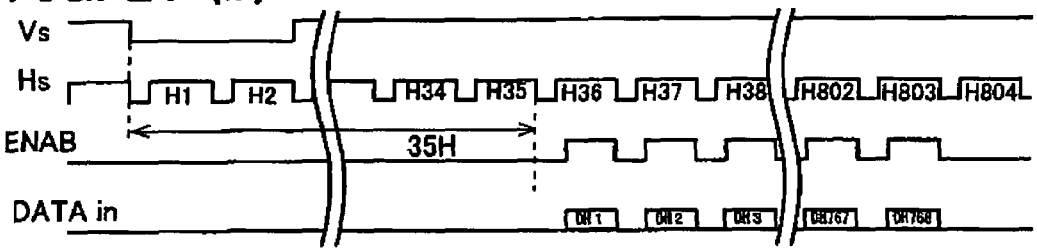
FIG. 26 (c) (PRIOR ART)
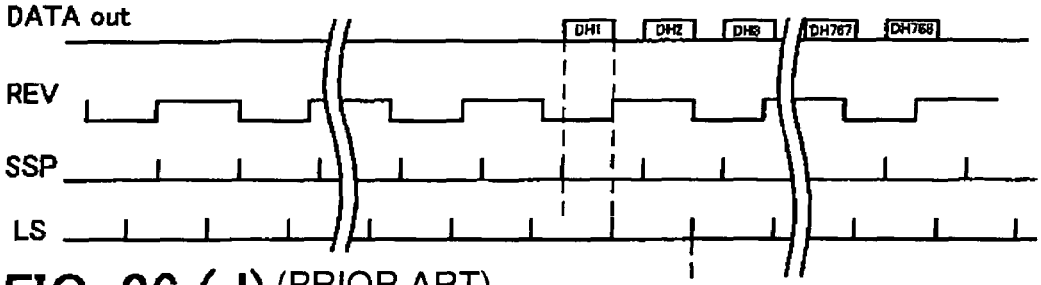
FIG. 26 (d) (PRIOR ART)
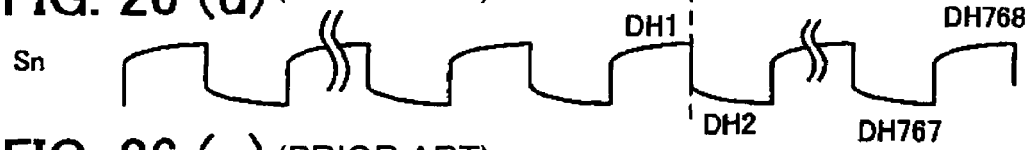
FIG. 26 (e) (PRIOR ART)
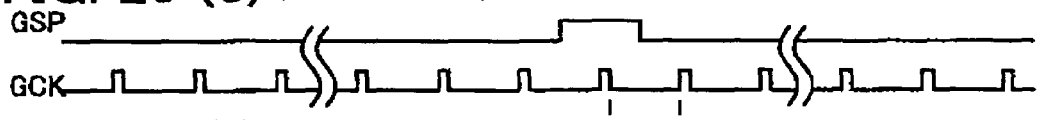
FIG. 26 (f) (PRIOR ART)
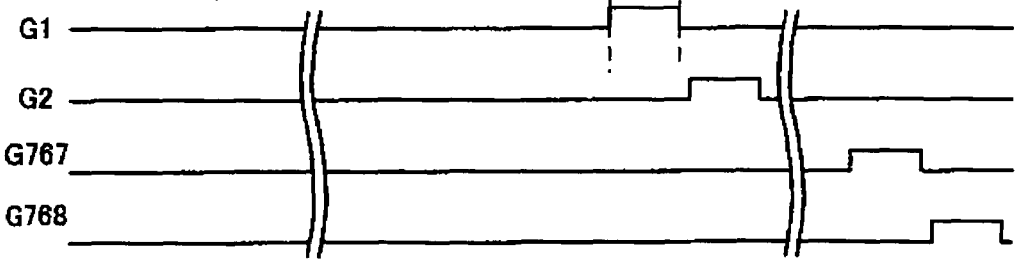

FIG. 27 (a) (PRIOR ART)
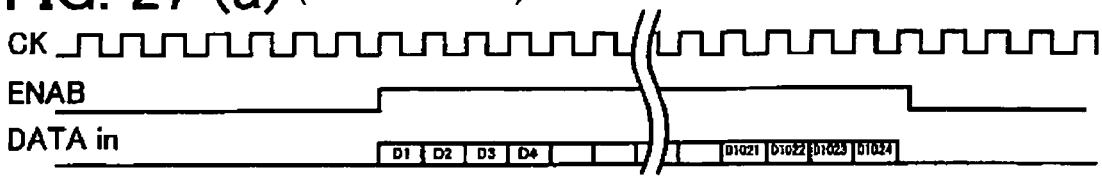
FIG. 27 (b) (PRIOR ART)
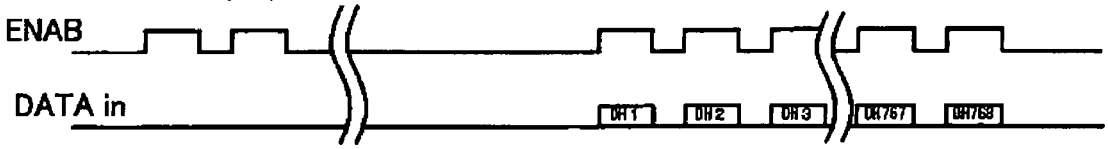
FIG. 27 (c) (PRIOR ART)
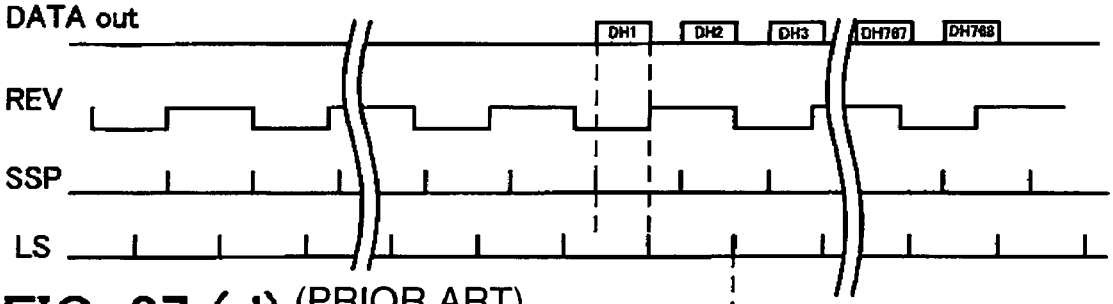
FIG. 27 (d) (PRIOR ART)
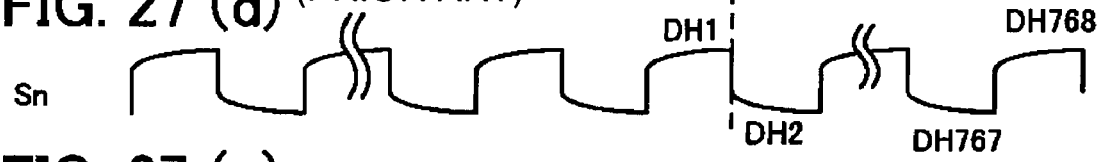
FIG. 27 (e) (PRIOR ART)
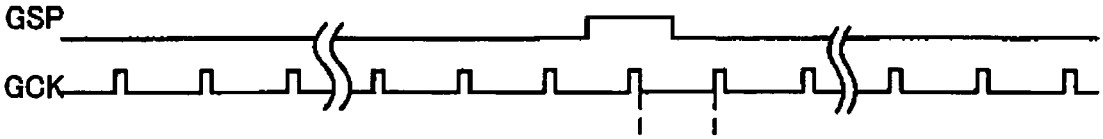
FIG. 27 (f) (PRIOR ART)
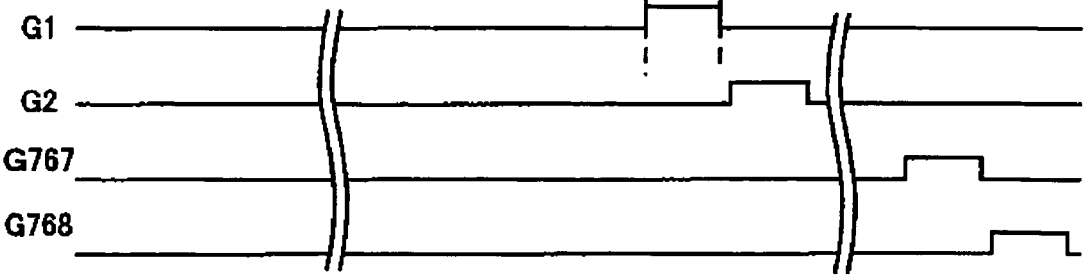

DISPLAY DEVICE, CONTROL DEVICE OF DISPLAY DRIVE CIRCUIT, AND DRIVING METHOD OF DISPLAY DEVICE

FIELD OF THE INVENTION

The present invention relates to the driving of a matrix display device.

BACKGROUND OF THE INVENTION

Commonly known matrix display devices are such as an active matrix substrate on which TFTs (Thin Film Transistors) are formed and a liquid crystal display device including driver ICs (Integrated Circuits) for driving the TFTs.

FIG. 18 illustrates a TFT active matrix liquid crystal display device 101. This liquid crystal display device 101 is provided with a gate driver 102 which is a circuit for driving rows of the matrix and a source driver 103 which is a circuit for driving columns of the matrix.

On a transparent substrate, a plurality of gate lines Gn, Gn+1 . . . (correctively termed G) driven by the gate driver 102 and a plurality of source lines Sn, Sn+1 . . . (correctively termed S) driven by the source driver 103 are formed. The gate lines G are orthogonal to the source lines S. At each of the intersections of the gate lines G and the source lines S, a pixel PIX is provided. This pixel PIX includes a TFT 104, a liquid crystal 105, and an auxiliary capacity 106. In each of the areas circumscribed by the gate lines G and the source lines S, a pixel electrode (cf. FIG. 19) 107 which is one of two electrodes of the liquid crystal 105 and the auxiliary capacity 106 is formed. This pixel electrode 107 is connected to a drain electrode of the TFT 104. In a pixel PIX at an n-th row and n-th column, a source electrode of the TFT 104 is connected to a source line Sn of the n-th row, and a gate electrode of the TFT 104 is connected to a gate line Gn of the n-th column.

In this manner, focusing attention on the relationship between the gate lines G and the pixel electrodes 107 in the liquid crystal display device 101 in which the pixels PIX are formed, it is noticed that the liquid crystal display device 101 in FIG. 18 is a so-called bottom-gate liquid crystal display device in which the gate line Gn of the n-th row is provided below the pixel electrode 107 of the n-th row. Further, as illustrated in FIG. 19, between the pixel electrode 107 and the gate line Gn and between the pixel electrode 107 and the gate line Gn−1, parasitic capacitances Cgd1 and Cgd2 are formed, respectively. In the pixel of the first row, a gate line G0 corresponding to the foregoing gate line Gn−1 of the pixel of the n-th pixel is not provided so that a parasitic capacitance corresponding to the foregoing parasitic capacitance Cgd2 is not formed. FIG. 18 illustrates the difference between an equivalent circuit of the pixel of the first row (line G1) in which the parasitic capacitance Cgd2 is not formed and an equivalent circuit of the pixel of the second low and later (Gn (n≠1)) in which the parasitic capacitances Cgd1 and Cgd2 are both formed.

In the meantime, as illustrated in FIG. 20, a gate signal having an amplitude Vgpp is serially supplied to the gate lines G, and this gate signal causes a drain level of the TFT 104 to vary. That is to say, in the pixel PIX of the n-th row, via the parasitic capacitance Cgd2, the gate signal of the gate line Gn−1 varies the drain level of the TFT 104 as much as ΔV2, and via the parasitic capacitance Cgd1, the gate signal of the gate line Gn varies the drain level of the TFT 104 as much as ΔV1.

Here, provided that the capacity of the liquid crystal of the pixel PIX is Clc and the auxiliary capacity is Ccs, the above-mentioned values ΔV2 and ΔV1 are expressed as follows.

$$\Delta V1 = Vgpp \times \{Cgd1/(Clc+Ccs+Cgd1+Cgd2)\}$$

$$\Delta V2 = Vgpp \times \{Cgd2/(Clc+Ccs+Cgd1+Cgd2)\}$$

Then the value ΔV1 generated by the gate signal of the gate line Gn of the same stage causes a center value Vcom of an amplitude of the drain level of the TFT 104 to be ΔV1 lower than a center value Vsc of an amplitude of a source signal. The value ΔV2 generated by the gate signal of the gate line Gn−1 of the previous stage causes an effective value of a voltage supplied to the liquid crystal 105 to increase.

As described above, in the pixel PIX of the first row, the gate line G0 of the previous stage, which forms the parasitic capacitance Cgd2, is not provided. For this reason, the value ΔV2 is not generated and this causes the effective value of the voltage supplied to the liquid crystal 105 in the pixel PIX of the first row to be lower than the effective values supplied to the respective pixels PIX of the remaining rows. Due to this difference of the effective values, the driving conditions of the display device deteriorates such that the value ΔV2 becomes large or the temperature becomes too high or low, and thus the brightness of the pixel PIX of the first row looks different from the brightness of the remaining pixels PIX. For instance, when normally while liquid crystal is adopted, the first line looks like a bright line.

To solve this problem, for instance, U.S. Pat. No. 5,867,139 (published on Feb. 2, 1999) and Japanese Laid-Open Patent Application No. 8-43793/1996 (published on Feb. 16, 1996) teach that, in a bottom-gate panel, a dummy line G0 for compensating asymmetry between the pixel of the first row and the remaining pixels is provided in the vicinity of the pixel of the first row and outside of an effective display area. The gate lines G1-Gm are driven by respective gate signal supplied from output terminals OG1-Ogm, and the added dummy line G0 and a gate line Gm of m-th (last) row are connected in a parallel manner so that these lines are simultaneously driven. Hereinafter, this technique is termed a conventional art 1.

FIG. 21 illustrates a gate driver 102 of the conventional art 1. This gate driver 102 is arranged in such a manner that a plurality of driver ICs 112 mounted on a TCP (Tape Carrier Package) by a TAB (Tape Automated Bonding) method are cascaded. The gate driver 102 connects a liquid crystal panel 113, on which pixels PIX, gate lines G, and source lines S are formed, with a printed board 114. Each of the driver ICs 112 includes 256 output terminals OG1-OG256. The figure illustrates a case that 3 driver ICs 112 are cascaded.

In the driver IC 112, via the printed board 114, a gate start pulse signal GSP is supplied to a terminal GSPin and a gate clock signal GCK is supplied to a terminal GCKin. Further, in the driver IC 112, the gate start pulse signal GSP, which has been shifted by an internal shift register, is outputted from a terminal GSPout, and supplied to a terminal GSPin of a driver IC 112 of the next stage, via the printed board 114. From a terminal OG256 of the last line of the driver IC 112 of the last stage, a line extends not only to the gate line G but also to the top of the liquid crystal panel 113 via the printed board 114. This line extending to the top of the liquid crystal panel 113 is the dummy line G0. With this arrangement, the dummy line G0 and the gate lines G1-G768 are formed.

FIG. 22 illustrates respective timing charts of the signals in the gate driver 102 in FIG. 21. The gate start pulse signal GSP is shifted at timings of the gate clock signal GCK, and in the course of the shifting, the gate signals are serially supplied from the terminals OG1, OG2, . . . , OG256 to the respective gate lines G. When the gate signal is outputted from a terminal OG256 of one of the driver ICs 112, the gate start pulse signal GSP is supplied from the terminal GSPout to a terminal GSPin of the driver IC 112 of the next stage.

However, this conventional art 1 has such a problem that only a driver circuit of an output terminal OGm, which drives a gate line Gm of an m-th (last) line, is under substantially doubled load, so that the waveform of the gate signal is blunted. Further, as in FIG. 21, since a bypass line for connecting the dummy line G0 and the gate line Gm via the printed board 114 is required, the liquid crystal panel 113 and the flexible printed board become intricate. To reduce costs, weight, and thickness of liquid crystal panels, it has been popular to adopt such an arrangement that a printed board, a flexible printed board, and connecter on the gate side are eliminated and power supply lines and signal lines on the side of a gate driver are formed on a liquid crystal panel and a gate driver TCP (hereinafter, this arrangement will be referred to as a gate substrate omission arrangement). In this arrangement, the power supply lines and signal lines connected to the gate driver are formed as a single-layer wiring pattern from the side of the source driver. Thus, this arrangement cannot allow the space for the line from the last m-th line to the dummy line G0 as in FIG. 21.

In this connection, as FIG. 23 illustrates, a gate driver IC in which the number of output terminals is increased in order to independently drive the dummy line G0 has been developed for solving the above-described problem. Hereinafter, this gate driver IC will be referred to as a conventional art 2. In the arrangement shown in FIG. 23, a driver IC 122 of each TCP 121 has terminals OG0-OG257. The number of the terminals of this driver IC 122 is larger than the number of the terminals of the aforementioned driver IC 122 in FIG. 21. In each of the driver ICs 122 of the respective stages, the terminals OG1-OG256 are connected to respective gate lines G. In the driver IC 122 of the first stage, the terminal OG0 is connected to a dummy line G0, while in the driver ICs 122 of the second and third stages, the terminals OG0 and OG257 are not used. Also in this arrangement, a gate start pulse signal GSP and a gate clock signal GCK are supplied via a printed board 124. However, since the dummy line G0 is driven using the terminal OG0 of the driver IC 122, it is unnecessary to provide a line for the dummy line G0, which extends from the driver IC 122 of the last stage to the top of a liquid crystal panel 123 via the printed board 124.

FIG. 24 illustrates timing charts of respective signals of the gate driver 102 in FIG. 23. First, a gate signal is supplied to the terminal OG0, and then the gate start pulse signal GSP is serially shifted. After the gate signal is outputted from the terminal OG 256, the gate start pulse signal GSP is supplied to the driver IC 122 of the next stage. Subsequently, from the terminal OG1 of this driver IC 122, the gate signal is outputted.

As illustrated in FIG. 25, this conventional art 2 can be adopted to a gate substrate omission arrangement in which lines to driver ICs 122 are formed only on a TCP 121 and a liquid crystal panel 123 so as not to pass through a printed board 124 as in FIG. 24. Also in this case, it is unnecessary to provide a lengthy line for a dummy line G0. On this account, the conventional art 2 makes it possible to realize and mass-produce a liquid crystal display device with the gate substrate omission arrangement.

However, according to the conventional art 2, it is necessary to supply the gate start pulse signal GSP, which is for supplying the output for the dummy line G0, to the gate driver 102. This gate start pulse signal GSP has to be supplied before an input data signal DATA-in and a data enable signal ENAB are supplied to a timing control ASIC which generates a signal for controlling the drive of the gate driver 102 and the source driver 103.

There are two controlling methods using the timing control ASIC, namely, a timing control method (hereinafter, HV mode) using vertical and horizontal synchronizing signals and a timing control method (hereinafter, V-ENAB mode) which only uses the data enable signal ENAB so as not to use the vertical and horizontal synchronizing signals. Referring to FIGS. 26(*a*)-26(*f*) and 27(*a*)-27(*f*), the HV mode and the V-NAB mode will be described.

First, the HV mode is described with reference to timing charts in FIGS. 26(*a*)-26(*f*).

FIG. 26(*a*) illustrates signals for horizontal drive, which are supplied to the timing control ASIC. The figure shows the timings of the signals in one horizontal period. In accordance with the timing of the input of the clock signal CK, the data enable signal ENAB goes high at 296-th clock from the input of a horizontal synchronizing signal Hs, and sets of data D1, D2, . . . , D1024 for one horizontal period are supplied. FIG. 26(*b*) illustrates signals for vertical drive, which are supplied to the timing control ASIC. The figure shows the timings of the signals in one vertical period. The data enable signal ENAB goes high after 35 horizontal periods have past from the input of a vertical synchronizing signal Vs, and during horizontal periods corresponding the rises of the data enable signal ENAB, respective sets of data DH1, DH2, . . . , DH 768 for one horizontal period of the input data signal DATAin are supplied.

FIG. 26(*c*) illustrates signals for horizontal drive, which are supplied from the timing control ASIC. To the source driver 103, the timing control ASIC supplies: the sets of data DH1, DH2, . . . , DH768; a liquid crystal drive inversion signal REV for reversing a signal level in each horizontal period; a source start pulse signal SSP for carrying out shifting in the source driver 103; and a latch strobe signal LS for latching the sets of data sampled in accordance with the shift timings of the source start pulse signal SSP, and outputting the latched sets of data to the respective source lines S. With this arrangement, the output waveforms from the source driver 103 are arranged as in FIG. 26(*d*).

FIG. 26(*e*) illustrates signals for vertical drive, which are supplied from the timing control ASIC. To the gate driver 102, the timing control ASIC outputs: the gate start pulse signal GSP for outputting the gate signals to cause the sets of data DH1, DH2, . . . , DH768, which are supplied from the source driver 103, to be serially supplied to the pixels of the respective rows; and the gate clock signal GCK for shifting the gate start pulse signal GSP. With this arrangement, as illustrated in FIG. 26(*f*), the gate driver 102 serially supply the gate signals, which are pulses, to the gate lines G.

In this manner, in the HV mode, a predetermined number of pulses of the horizontal synchronizing signal Hs, each having a predetermined length of time, is counted from the input of the vertical synchronizing signal VS, and subsequently the data enable signal ENAB and the input data signal DATAin are supplied. Thus, in the HV mode, from the supplied vertical synchronizing signal Va and horizontal synchronizing signal Hs, it is possible to generate the gate start pulse signal GSP at the timing of driving the dummy line G0 before driving the gate line G1.

Next, the V-ENAB mode will be described with reference to timings charts in FIGS. 27(*a*)-27(*f*).

FIG. 27(*a*) illustrates signals for horizontal drive, which are supplied to the timing control ASIC. The figure shows the timings of the signals in one horizontal period. No horizontal synchronizing signal is provided, and the data enable signal ENAB is supplied at a timing during the clock signal CK is supplied so that sets of data D1, D2, . . . , D1024 for one horizontal period are supplied. FIG. 27(*b*) illustrates signals for vertical drive, which are supplied to the timing control ASIC. Neither the vertical synchronizing signal nor the horizontal synchronizing signal are provided, and a length of the data enable signal ENAB supplied at a timing corresponds to a length during which the source driver 103 samples the data DH1, DH2, . . . , DH768 of one horizontal period.

FIGS. 27(*c*)-27(*f*) are identical with FIGS. 26(*c*)-26(*f*), except that the timings of the signals outputted from the timing control ASIC are determined with reference to the input timing of the data enable signal ENAB.

FIG. 28 illustrates a timing control ASIC 108, as an example of a timing control ASIC controlled in the V-ENAB mode. In this timing control ASIC 108, a separation/control section 108*a* separates a reference timing for horizontal drive and a reference timing for vertical drive from the supplied data enable signal ENAB and clock signal CK. A horizontal counter 108*b* starts to count the clocks of the clock signal CK from the reference timing for horizontal drive. A vertical counter 108*c* starts to count rising edges of the ENAB signal from the reference timing of vertical drive. In accordance with the result of the counting by the horizontal counter 108*b*, a horizontal signal timing generation block 108*d* generates and outputs the gate clock signal GCK, the latch strobe signal LS, the source clock signal SCK, and the source start pulse signal SSP. Also, in accordance with the result of the counting by the vertical counter 108*c*, a vertical signal timing generation block 108*e* generates and outputs the gate start pulse signal GSP. Further, in accordance with the results of the counting by the horizontal counter 108*b* and vertical counter 108*c*, a liquid crystal drive inversion signal generation block 108*f* generates and outputs the liquid crystal drive inversion signal REV. The input data signal DATAin is supplied to an input buffer 108*g*, and as output data, the input data signal DATAin is outputted from an output buffer 108*h*.

In this manner, in the V-ENAB mode, the vertical and horizontal synchronizing signals are not supplied to the timing controller ASIC as in the case of the HV mode. For this reason, the gate start pulse signal GSP has to be generated from a pulse of the data enable signal ENAB supplied at the timing of inputting the data DH1 of the first line.

Thus, according to the conventional art 2, since it is not possible to generate the gate start pulse signal GSP to cause a signal for driving the dummy line G0 to be outputted before the gate signal of the gate line G1, it is not possible to perform the operation in the V-NAB mode. As the operation in the V-NAB mode is often required these days, this problem requires urgent solution.

To solve the problems of the conventional arts 1 and 2, US Patent Application No. 2001/0050678 A1 (published on Dec. 13, 2001) teaches that the internal mechanism of a gate driver IC is modified so that gate signals are serially outputted in an order different from the order of providing terminals. FIG. 29 shows this arrangement. In a gate driver 102 in the figure, driver ICs 132 are provided instead of the driver ICs 122 of the gate driver 102 in FIG. 23. The internal mechanism of the driver IC 132 is illustrated in FIG. 30. A gate start pulse signal GSP is transferred in an internal shift register in the order of R1→R2→ . . . →R256→R0. Further, as illustrated in FIG. 31, simultaneously with the drive of a last gate line G256 by a terminal OG256 for transferring the gate start pulse signal GSP to the R256, the gate start pulse signal GSP is supplied from a terminal GSPout to the driver IC 132 of the next stage. Then at the timing of driving the dummy line G0 of the previous stage, a gate line G257 is driven by a terminal OG1 of the driver IC 132 of the next stage. Hereinafter, this arrangement will be referred to as a conventional art 3.

However, since the driver IC 132 of the gate driver 102 of the conventional art 3 has to be specially arranged to perform the gate output in the order different to the order of the output terminals, it is impossible to adopt a conventional driver IC which perform the gate output in the order corresponding to the order of the output terminals. That is to say, illustrating this arrangement with reference to FIG. 29, the driver IC 132 of the first stage cannot be a driver IC which outputs gate signals in the order of the output terminals OG0→OG1→ . . . →OG256. Thus, to adopt the conventional art 3, it is necessary to newly develop driver ICs corresponding to various resolutions, and this requires considerable time and expense. As in the foregoing description, it has been required to develop a method of driving a dummy line G0, adopting a conventional driver IC which drives in the order corresponding to the order of output terminals.

SUMMARY OF THE INVENTION

The objectives of the present invention are to provide: a display device and a control device of a display drive circuit, which can perform displaying in a mode that the display timing is controlled by a data enable signal, i.e. in a V-ENAB mode, by adopting, as a row drive circuit for driving rows of a display panel in which a dummy row line is provided on the top of the panel, a drive circuit constituted by conventional driver ICs (i) which are wired on the condition that a printed board is not provided outside a display panel and (ii) in each of which output terminals are driven in the order identical with the order of providing the output terminals; and a driving method of the display device.

To achieve these objectives, the display device of the present invention comprises: a display panel on which pixels corresponding to respective intersections of row lines and column lines are provided in a matrix manner; a row drive circuit which receives a row drive timing signal for driving the row lines of the display panel, and sequentially supplies row drive signals for driving the row lines to the respective row lines connected to the pixels, in accordance with the row drive timing signal; a column drive circuit which receives display data and a column drive timing signal for driving the column lines of the display panel, and supplies column drive signals corresponding to the display data to the respective column lines connected to the pixels, in accordance with the column drive timing signal; and a control device which receives the display data, a data enable signal, and a clock signal, generates the row drive timing signal from the data enable signal and the clock signal and outputs the row drive timing signal to the row drive circuit, and generates the column drive timing signal from the data enable signal and the clock signal and supplies the column drive timing signal to the column drive circuit, along with the display data, during a period from the timing of inputting the data enable signal to a start of outputting the column drive signals of a first horizontal period of one vertical period, the control device generating the row drive timing signal with reference to a timing of inputting the data enable signal in order to cause one of the row drive signals to be supplied to a first output terminal of the row drive circuit, and then supplying the row drive timing signal, which has been generated, to the row drive circuit.

According to this arrangement, the control device generates the row drive timing signal from the data enable signal and the clock signal with reference to the timing of inputting the data enable signal in order to cause one of the row drive signals to be supplied to the first output terminal of the row drive circuit, and supplies the row drive timing signal, which has been generated, to the row drive circuit, during the period from the timing of inputting the data enable signal to a start of outputting the column drive signals of a first horizontal period of one vertical period, the control device generating the row drive timing signal with reference to a timing of inputting the data enable signal in order to cause one of the row drive signals to be supplied to a first output terminal of the row drive circuit.

Thus, when the first output terminal of the row drive circuit is connected to the dummy row line which is provided to cause the parasitic capacitance of the first effective pixel to be identical with the parasitic capacitances of the remaining pixels, the followings are realized. That is to say, when displaying is performed in the mode that the display timing is controlled by the data enable signal, the dummy row line can be driven before the row drive signal of the first horizontal period is supplied to the row drive lines. In other words, after driving the dummy row line, the row lines are serially driven from the first one to the last one. With this arrangement, it is possible to realize the row drive circuit by adopting conventional driver ICs in which the output terminals are driven in the order identical with the order of the output terminals. Further, since the dummy row lines are connected to the first output terminal, it is unnecessary to provide a lengthy line from another output terminal of one of the driver ICs. For this reason, the dummy row line can be driven even if a printed board for the connection to the row drive circuit is not provided outside the display panel.

As described above, it is possible to provide a display device which can perform displaying in a mode that the display timing is controlled by a data enable signal, by adopting, as a row drive circuit for driving rows of a display panel in which a dummy row line is provided on the top of the panel, a drive circuit constituted by conventional driver ICs (i) which are wired on the condition that a printed board is not provided outside a display panel and (ii) in each of which output terminals are driven in the order identical with the order of providing the output terminals.

Further, since it is unnecessary to simultaneously drive one of the row lines and the dummy row line as in the conventional art 3, problems such as a blunted row drive signal waveform do not occur. Thus, it is possible to avoid the degradation of the display quality. Also, since conventional driver ICs can be adopted, it is possible to realize a multi-vendor environment.

To achieve the foregoing objectives, the display device of the present invention comprises: a display panel on which pixels corresponding to respective intersections of row lines and column lines are provided in a matrix manner; a row drive circuit which receives a row drive timing signal for driving the row lines of the display panel, and sequentially supplies row drive signals for driving the row lines to the respective row lines connected to the pixels, in accordance with the row drive timing signal; a column drive circuit which receives display data and a column drive timing signal for driving the column lines of the display panel, and supplies column drive signals corresponding to the display data to the respective column lines connected to the pixels, in accordance with the column drive timing signal; and a control device which receives the display data, a data enable signal, and a clock signal, generates the row drive timing signal from the data enable signal and the clock signal and outputs the row drive timing signal to the row drive circuit, and generates the column drive timing signal from the data enable signal and the clock signal and supplies the column drive timing signal to the column drive circuit, along with the display data, the row drive circuit being arranged such that, driver ICs are disposed in accordance with a system-on-film structure, a line passing under an IC chip of predetermined one of the driver ICs is connected to an output terminal next to an output terminal corresponding to a last one of the row lines of said predetermined one of the driver ICs, and the line passing under the IC chip is provided before a first one of the row lines provided on the display panel, acting as a dummy row line.

According to this arrangement, the system-on-film structure is adopted so that a line passing below the IC chip is connected to the output terminal next to the output terminal corresponding to the last one of the row lines of the predetermined one of the driver ICs. Further, the dummy row line provided before the first row line of the display panel can act as a dummy row line for causing the parasitic capacitance of the first effective pixel to be equal to the parasitic capacitances of the remaining pixels. With this arrangement, the dummy row line can be provided even if a printed board for the connection to the row drive circuit is not provided outside the display panel.

Since the drive of the dummy row line can be performed after the remaining row lines are driven in the order of the output terminals of the predetermined driver IC, it is unnecessary to drive the dummy row line before the remaining row lines are driven, when displaying is performed on condition that the display timing is controlled by the data enable signal. With this arrangement, it is possible to adopt conventional driver ICs in each of which the output terminals are driven in the order identical with the order of the output terminals, as the driver ICs of the present invention.

As described above, it is possible to provide a display device which can perform displaying in a mode that the display timing is controlled by a data enable signal, by adopting, as a row drive circuit for driving rows of a display panel in which a dummy row line is provided on the top of the panel, a drive circuit constituted by conventional driver ICs (i) which are wired on the condition that a printed board is not provided outside a display panel and (ii) in each of which output terminals are driven in the order identical with the order of providing the output terminals. Also, since conventional driver ICs can be adopted, it is possible to realize a multi-vendor environment.

To achieve the foregoing objectives, the control device of the display drive circuit of the present invention is arranged in such a manner that, the display drive circuit includes: a row drive circuit which receives a row drive timing signal which is for driving row lines of a display panel on which pixels corresponding to respective intersections of the row lines and column lines are provided in a matrix manner, and serially outputs row drive signals, which are for driving the row lines, to the respective row lines connected to the pixels, in accordance with the row drive timing signal; and a column drive circuit which receives display data and a column drive timing signal which is for driving the column lines of the display panel, and outputs column drive signals, which correspond to the display data, to the respective column lines connected to the pixels, in accordance with the column line drive timing signal, the control device receives the display data, a data enable signal, and a clock signal, generates the row drive timing signal from the data enable signal and the clock signal and supplies the row drive timing signal to the row drive circuit, and generates the column drive timing signal from the data enable signal and supplies the clock signal to the column drive circuit, along with the display data, and during a period from the timing of inputting the data enable signal to a start of outputting the column drive signals of a first horizontal period of one vertical period, the control device generates the row drive timing signal with reference to a timing of inputting the data enable signal, in order to cause one of the row drive signals to be supplied to a first output terminal of the row drive circuit, and then supplies the row drive timing signal, which has been generated, to the row drive circuit.

According to this arrangement, it is possible to provide a display device which can perform displaying in a mode that the display timing is controlled by a data enable signal, by adopting, as a row drive circuit for driving rows of a display panel in which a dummy row line is provided on the top of the panel, a drive circuit constituted by conventional driver ICs (i) which are wired on the condition that a printed board is not provided outside a display panel and (ii) in each of which output terminals are driven in the order identical with the order of providing the output terminals.

To achieve the foregoing objectives, the driving method of the display device of the present invention is arranged in such a manner that, the display device includes: a display panel on which pixels corresponding to respective intersections of row lines and column lines are provided in a matrix manner; a row drive circuit which receives a row drive timing signal for driving the row lines of the display panel, and sequentially supplies row drive signals for driving the row lines to the respective row lines connected to the pixels, in accordance with the row drive timing signal; a column drive circuit which receives display data and a column drive timing signal for driving the column lines of the display panel, and supplies column drive signals corresponding to the display data to the respective column lines connected to the pixels, in accordance with the column drive timing signal; and a control device which receives the display data, a data enable signal, and a clock signal, generates the row drive timing signal from the data enable signal and the clock signal and outputs the row drive timing signal to the row drive circuit, and generates the column drive timing signal from the data enable signal and the clock signal and supplies the column drive timing signal to the column drive circuit, along with the display data, the display data, a data enable signal, and a clock signal are received, the row drive timing signal is generated from the data enable signal and the clock signal and supplied to the row drive circuit, and the column drive timing signal is generated from the data enable signal and the clock signal and supplied to the column drive circuit, along with the display data, and during a period from the timing of inputting the data enable signal to a start of outputting the column drive signals of a first horizontal period of one vertical period, the row drive timing signal is generated with reference to a timing of inputting the data enable signal, in order to cause one of the row drive signals to be supplied to a first output terminal of the row drive circuit, and then the row drive timing signal, which has been generated, is supplied to the row drive circuit.

According to this arrangement, it is possible to provide a display device which can perform displaying in a mode that the display timing is controlled by a data enable signal, by adopting, as a row drive circuit for driving rows of a display panel in which a dummy row line is provided on the top of the panel, a drive circuit constituted by conventional driver ICs (i) which are wired on the condition that a printed board is not provided outside a display panel and (ii) in each of which output terminals are driven in the order identical with the order of providing the output terminals.

For a fuller understanding of the nature and advantages of the invention, reference should be made to the ensuing detailed description taken in conjunction with the accompanying drawings.

BRIEF DESCRIPTION OF THE DRAWINGS

FIG. 26(*a*) illustrates timing charts regarding signals for describing display operations of the conventional liquid crystal display device in a HV mode.

FIG. 26(*b*) illustrates timing charts regarding signals for describing display operations of the conventional liquid crystal display device in a HV mode.

FIG. 26(*c*) illustrates timing charts regarding signals for describing display operations of the conventional liquid crystal display device in a HV mode.

FIG. 26(*d*) illustrates timing charts regarding signals for describing display operations of the conventional liquid crystal display device in a HV mode.

FIG. 26(*e*) illustrates timing charts regarding signals for describing display operations of the conventional liquid crystal display device in a HV mode.

FIG. 26(*f*) illustrates timing charts regarding signals for describing display operations of the conventional liquid crystal display device in a HV mode.

FIG. 27(*a*) illustrates timing charts regarding signals for describing display operations of the conventional liquid crystal display device in a V-NAB mode.

FIG. 27(*b*) illustrates timing charts regarding signals for describing display operations of the conventional liquid crystal display device in a V-NAB mode.

FIG. 27(*c*) illustrates timing charts regarding signals for describing display operations of the conventional liquid crystal display device in a V-NAB mode.

FIG. 27(*d*) illustrates timing charts regarding signals for describing display operations of the conventional liquid crystal display device in a V-NAB mode.

FIG. 27(*e*) illustrates timing charts regarding signals for describing display operations of the conventional liquid crystal display device in a V-NAB mode.

FIG. 27(*f*) illustrates timing charts regarding signals for describing display operations of the conventional liquid crystal display device in a V-NAB mode.

DESCRIPTION OF THE EMBODIMENTS

Embodiment 1

The following will describe an embodiment of the present invention with reference to FIGS. 1-4.

A liquid crystal display device (display device) of the present embodiment adopts a XGA TFT active matrix method with 1024×768 pixels. as in the case of the above-described conventional art, the liquid crystal display device includes a timing control ASIC (control device), a gate driver (row drive circuit), a source driver (column drive circuit), and a liquid crystal panel (display panel). Further, also in the present embodiment, the bottom-gate arrangement is adopted as in the case of the conventional art. This liquid crystal display device adopting a gate substrate omission arrangement operates in a V-ENAB mode.

Figure 2:
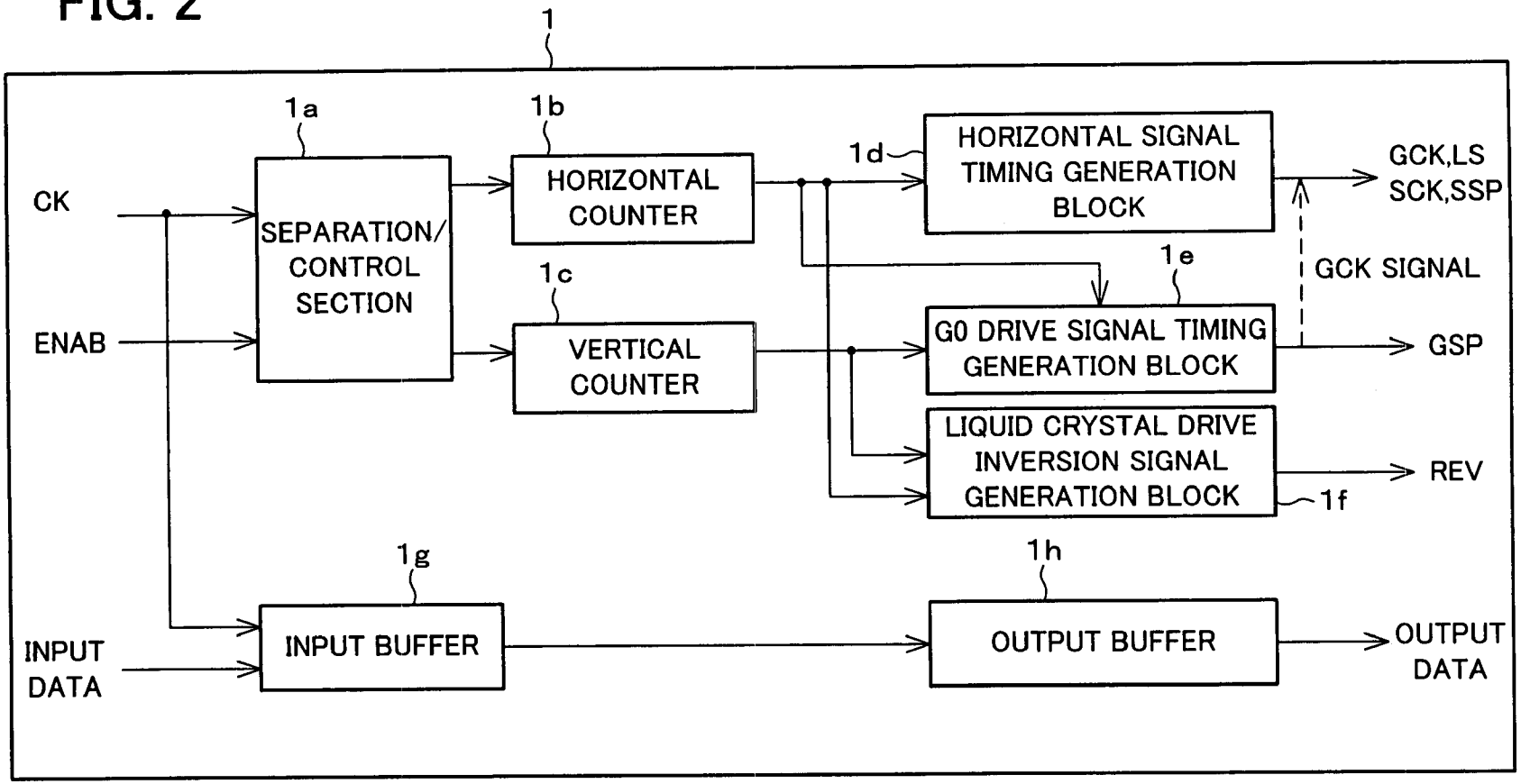
FIG. 2 is a block diagram illustrating an arrangement of the timing control ASIC of the liquid crystal display devise in accordance with Embodiment 1 of the present invention.

FIG. 2 illustrates an arrangement of a timing control ASIC (hereinafter control IC) 1 of the present embodiment. The control IC1 includes a separation/control section 1*a*, a horizontal counter 1*b*, a vertical counter 1*c*, a horizontal signal timing generation block 1*d* (shift clock signal generation section), a G0 drive signal timing generation block 1*e* (start pulse signal generation section), a liquid crystal drive inversion signal generation block 1*f*, an input buffer 1*g*, and an output buffer 1*h*.

The separation/control section 1*a* separates a reference timing for horizontal drive and a reference timing for vertical drive from a supplied data enable signal ENAB and a supplied clock signal CK, respectively. The horizontal counter 1*b* counts the clocks of the clock signal CK, from the reference timing for horizontal drive separated by the separation/control section 1*a*. The vertical counter 1*c* counts the rising edges of the ENAB signal, from the reference timing for vertical drive separated by the separation/control section 1*a*. In accordance with the result of the counting by the horizontal counter 1*b*, the horizontal signal timing generation block 1*d* generates and outputs a gate clock signal (timing signal for row drive) GCK, a latch strobe signal (timing signal for column drive) LS, a source clock signal (timing signal for column drive) SCK which is a display data sampling clock, and a source start pulse signal (timing signal for column drive) SSP which is a display data sampling start signal. On this occasion, as in FIG. 1, a pulse CK1 is generated as the gate clock GCK, before the generation of pulses CK2, CK3, CK4 . . . and the like. The pulses CK2, CK3, CK4 . . . and the like go high after predetermined clocks are counted, and then go low at the timing of the fall of the data enable signal ENAB. The pulse CK1 goes high after predetermined and small number of clocks are counted from the timing of the input (rise) of the data enable signal ENAB, and subsequently goes low after the predetermined clocks have past.

Figure 1:
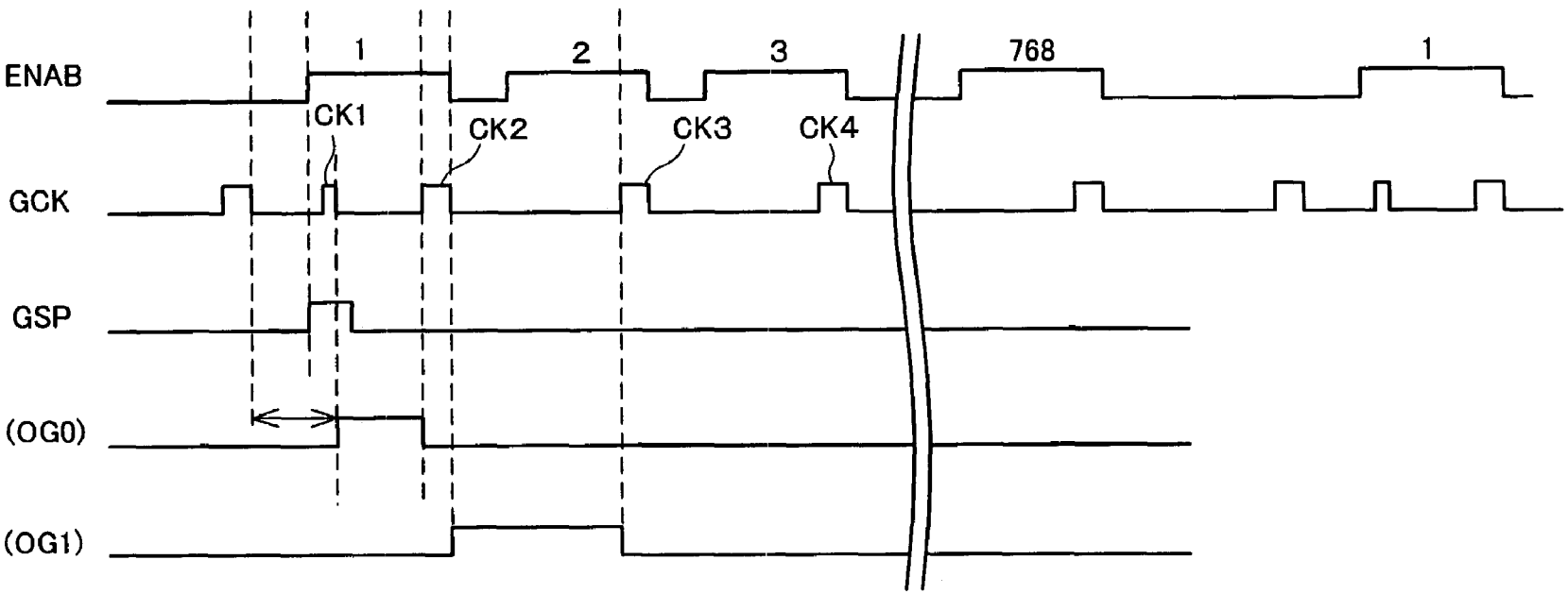
FIG. 1 illustrates timing charts of signals regarding a timing control ASIC of a liquid crystal display device in accordance with Embodiment 1 of the present invention.

In accordance with the results of the counting by the horizontal and vertical counters 1*b* and 1*c*, the G0 drive signal timing generation block 1*e* generates and outputs a gate start pulse signal (timing signal for row drive) GSP. In this case, as illustrated in FIG. 1, the gate start pulse signal GSP goes high at the timing of the input of the data enable signal ENAB corresponding to the first horizontal period of one vertical period, and goes low after the above-mentioned pulse CK1 goes low.

In accordance with the results of the counting by the horizontal and vertical counters 1*b* and 1*c*, the liquid crystal drive inversion signal generation block 1*f* generates and outputs a liquid crystal drive inversion signal REV. The input buffer 1*g* obtains an input data signal (display data) at a timing of the clock signal CK. The output buffer 1*h* receives the input data signal from the input buffer 1*g* and then outputs the same.

Figure 3:
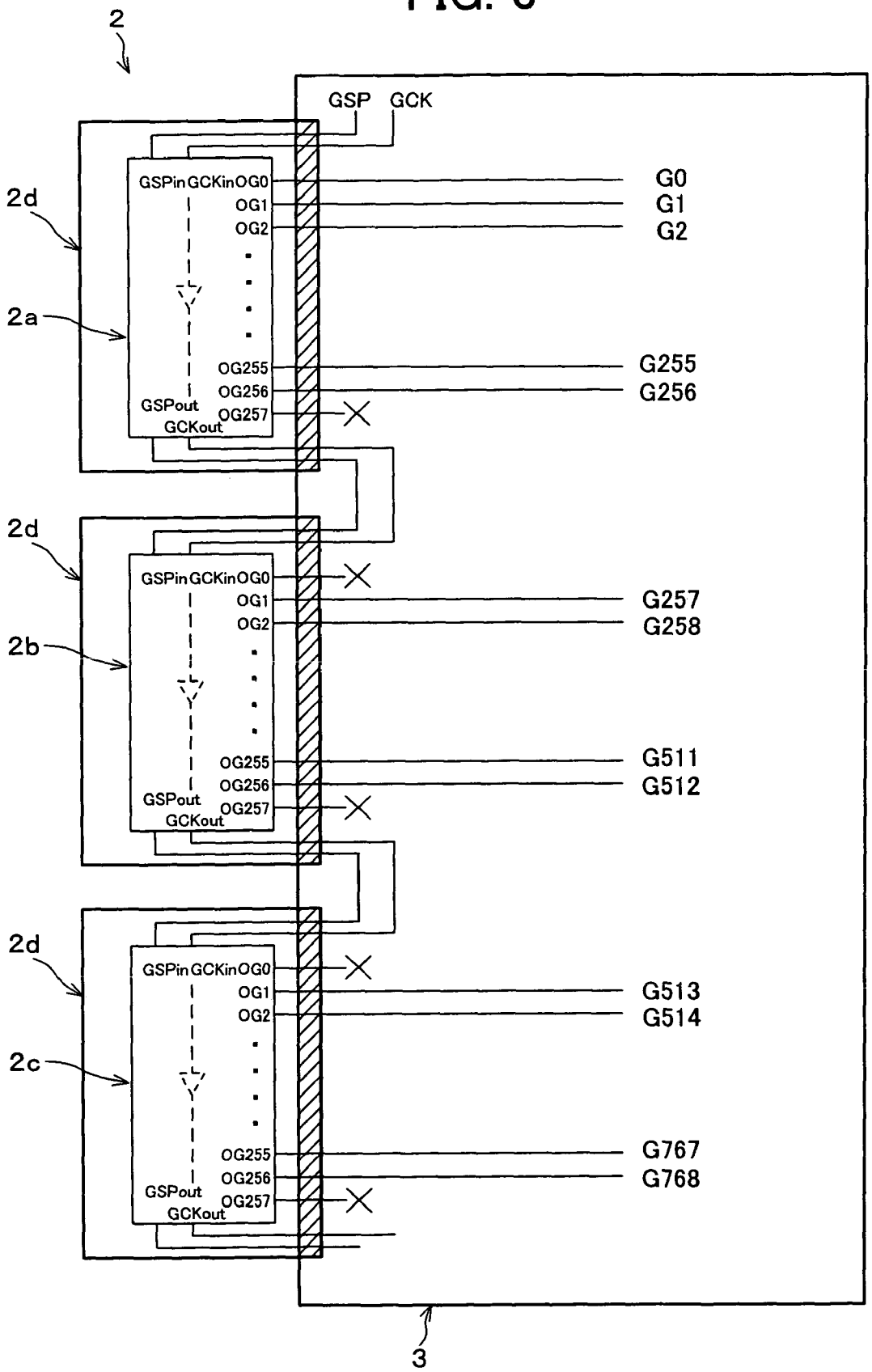
FIG. 3 is a plan view illustrating a gate driver of the liquid crystal display device in accordance with Embodiment 1 of the present invention, and members around the gate driver.

Next, a gate driver 2 of the present embodiment is illustrated in FIG. 3. The gate driver 2 drives gate lines (row lines) of a liquid crystal panel 3. The liquid crystal panel 3 includes 768 gate lines G1, G2, . . . , G768 connected to respective effective pixels, and a dummy line G0 as a dummy gate line, which is provided in the stage before the gate line G1. To drive these 769 lines, the gate driver 2 includes three driver ICs being cascaded, each of the driver ICs having 258 output terminals. To avoid redundant output terminals being disproportionately provided at the top and bottom ends of the liquid crystal panel 3, each of the driver ICs is arranged so as to have two redundant output terminals in addition to 256 output terminals. Note that, each of the driver ICs may have 257 output terminals on condition that the connection between the liquid crystal panel and each of the driver ICs is properly modified. However, to drive a dummy line with a dummy pixel as in the following Embodiment 3, each of the driver ICs is arranged to have 258 output terminals.

These three driver ICs are termed driver IC 2*a*, driver IC 2*b*, and driver IC 2*c*, from the top (on the side of the dummy line G0) of the liquid crystal panel 3. The driver ICs 2*a*, 2*b*, and 2*c* are TCP-mounted on respective carrier tapes 2*d* by a TAB method. The output terminals, which can output gate signals (row drive signals), in each of the driver ICs 2*a*, 2*b*, and 2*c* are termed OG0, OG1, OG2, . . . , OG257.

In the driver IC 2*a*, the terminal OG0 is connected to the dummy line G0, and the terminals OG1, OG2, OG256 are connected in this order to the gate lines G1, G2, . . . , G256. respectively, and hence the terminal OG257 is a dummy terminal. In the driver IC 2*b*, the terminals OG1, OG2, . . . , OG256 are connected in this order to the gate lines G257, G258, . . . , G512, and hence the terminals OG0 and OG257 are dummy terminals. In the driver IC 2*c*, the terminal OG1, OG2, . . . , OG256 are connected in this order to the gate lines G513, G514, . . . , G768, and hence the terminals OG0 and OG257 are dummy terminals.

Further, to terminals GSPin and GCKin of the driver IC 2*a*, the gate start pulse signal GSP and the gate clock signal (shift clock signal) GCK are supplied from the control IC 1 via the liquid crystal panel 3. The gate start pulse signal GSP and the gate clock signal GCK enter the liquid crystal panel 3 from the side of the source driver. The gate clock signal GCK may be self-transferred via the buffer in the IC chip, or may be transferred below the IC chip by means of SOF (System On Film) arrangement, provided that a SOF line is provided.

The gate start pulse signal GSP and the gate clock signal GCK are outputted from respective terminals GSPout and GCKout of the driver IC 2*a*, then supplied to respective terminals GSPin and GCKin of the driver IC 2*b*, and subsequently transferred to the driver IC 2*c* in a similar manner. The driver ICs 2*a*, 2*b*, and 2*c* are cascaded in this wise.

The present embodiment pays attention to the fact that it takes about one horizontal period to transfer display data of the first line to the source driver IC, in the case of the V-ENAB mode. That is to say, in order to cause the dummy line G0 to drive during the source driver IC samples the display data of the first line, the control IC 1 outputs the gate start pulse signal GSP and the gate clock signal GCK for driving the dummy line, immediately after the input of the data enable signal ENAB of the first line.

Figure 4:
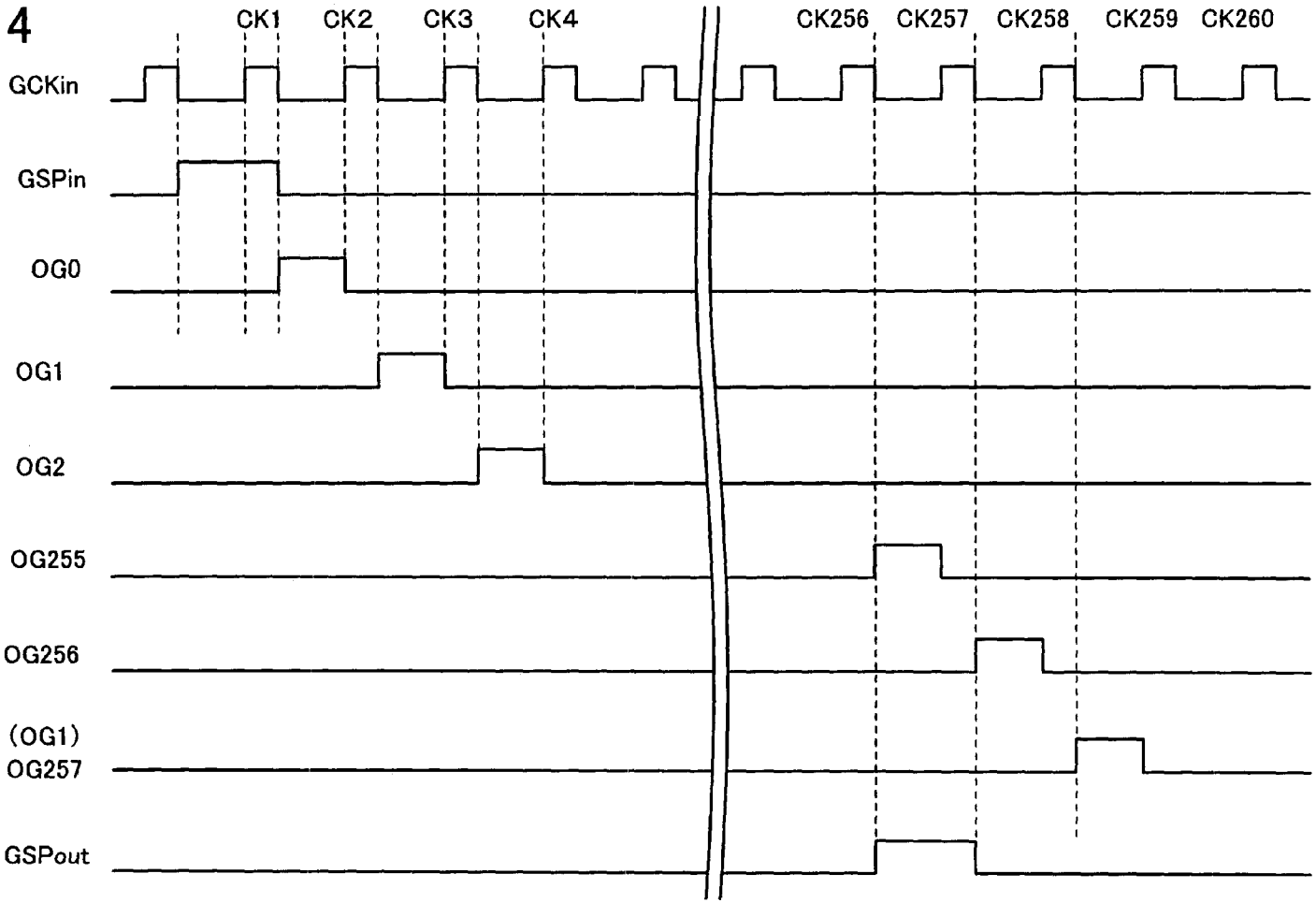
FIG. 4 illustrates timing charts of signals regarding the gate driver in FIG. 3.

When a "High" pulse of the gate start pulse signal GSP is supplied from the control IC 1, as FIG. 4 illustrates, the gate start pulse signal GSP is sampled at the timing of the fall of the gate clock signal GCK. Then this sampled signal is transferred to the terminals OGn (n=0, 1, . . . , 256) by the shift registers inside the respective driver ICs 2*a*, 2*b*, and 2*c*. The terminal OG0 of the driver IC 2*a* starts to receive the gate signal at the timing of the fall of the pulse CK1 of the gate clock signal GCK in FIG. 4, and the receiving continues until the timing of the rise of the pulse CK2. During this period, the dummy line G0 is driven.

Subsequently, the gate signals are serially outputted to the respective gate signals, such as the terminal OG1 receives the gate signal from the timing of the rise of a pulse CK2 to the timing of the rise of a pulse CK3, and the terminal OG2 receives the gate signal from the timing of the fall of the pulse CK3 to the timing of the rise of a pulse CK4. As a result, the gate lines G are serially driven. Simultaneously with the start to supply the gate signal to the terminal OG1, the latch strobe signal LS is supplied from the control IC 1 to the source driver, and a write signal corresponding to the display data of the first horizontal period in one vertical period is outputted from the source driver. In this manner, the write signals are supplied to the pixels during the period of outputting the gate signals. Then simultaneously with the supply of the gate signal to the terminal OG255 of the driver IC 2*a*, the gate start pulse signal GSP is outputted from the terminal GSPout, and, after the supply of the gate signal to the terminal OG256 of the driver IC2*a*, the terminal OG1 of the driver IC 2*b* receives the gate signal.

In this manner, according to the liquid crystal display device of the present embodiment, the control IC 1 generates the gate start pulse signal GSP and the gate clock signal GCK from the data enable signal ENAB and the clock signal CK, respectively, with reference to the timing of the input of the data enable signal ENAB, then supplies these generated signals to the gate driver 2, in order to cause the gate driver 2 to output the gate signal to the output terminal OG0 which is the uppermost terminal, and subsequently the source driver starts to output the write signal corresponding to the display data of the first horizontal period in one vertical period.

Thus, on the occasion of performing displaying in the V-ENAB mode, it is possible to drive the dummy line G0 before outputting the write signal of the first horizontal period to a source line S. That is to say, after driving the dummy line G0, the gate lines G are driven in the top-to-bottom order. With this arrangement, it is possible to construct the gate driver 2 using conventional driver ICs 2*a*, 2*b*, and 2*c* in each of which output terminals are driven in the order identical with the order of providing output terminals. Further, since the dummy line G0 is connected to the uppermost output terminal OG0, it is unnecessary to provide a lengthy line to connect the dummy line G0 with another output terminal of the driver IC as in the conventional art. For this reason, it is possible to drive the dummy line G0 even if the gate substrate omission arrangement is adopted.

As described above, it is possible to perform displaying in a mode that the display timing is controlled by a data enable signal, by adopting, as a row drive circuit for driving rows of a display panel in which a dummy row line is provided on the top of the panel, a drive circuit constituted by conventional driver ICs (i) which are wired on the condition that a printed board is not provided outside a display panel and (ii) in each of which output terminals are driven in the order identical with the order of providing the output terminals. Also, since conventional driver ICs can be adopted, it is possible to realize a multi-vendor environment.

Further, according to the liquid crystal display device in accordance with the present embodiment, the control IC 1 starts to generate the start pulse signal GSP at the timing of inputting the data enable signal ENAB to the control IC 1. Then at the instant that the clocks of the clock signal CK are counted for a predetermined number, the pulse CK 1 which is the first clock of the gate clock signal GCK is generated. The gate driver 2 obtains the start pulse signal GSP in order to drive the dummy line G0. On this account, it is possible to determine the number of the counting of the clocks, in accordance with a set-up hold period of the driver IC 2*a* used for the gate driver 2. Then in accordance with the characteristics of the driver IC 2*a*, the dummy line G0 is driven.

Referring to FIG. 1, a gate signal waveform of the dummy line G0 is a pulse which is shorter than a gate signal waveform of the gate line Gm (m≠0) by a horizontal return period. This period by which the gate signal is shorter is, for instance, 5 μsec with respect to one horizontal period which is 20.7 μsec, provided that XGA resolution and VESA standard timing are adopted. However, the drive period of the dummy line G0 can be arbitrarily determined on condition that the variation of a pixel electrode voltage caused by a parasitic capacitance is arranged so as to be equivalent to the variation in the pixels of the following rows. The exemplified value is suitable for a liquid crystal display value with a Cs on-common arrangement.

To adopt the gate substrate omission arrangement to a liquid crystal display device with a narrow frame, which is used for, for instance, notebook PCs, it is necessary to use thinner power supply lines and signal lines for driving gate driver ICs. As a result, the wiring resistance of a gate drive power supply tends to be increased. In the case of the conventional art 3 illustrated in FIG. 32, the driver IC simultaneously drives two gate lines at the timing of driving the gate line G257, so that a current passing through the gate power supply is doubled only at this timing, and hence problems such as a blunted gate signal waveform are caused. On this account, nonuniformity of luminance such that the pixels of the gate lines look abnormal occurs, and the degradation of the display quality becomes obvious.

In contrast, in the liquid crystal display device of the present embodiment, it is unnecessary to simultaneously drive one of the gate lines G and the dummy line G0 as in the case of the conventional art 3, so that the gate signal waveform is not blunted and the degradation of the display quality can be avoided.

Embodiment 2

Figure 5:
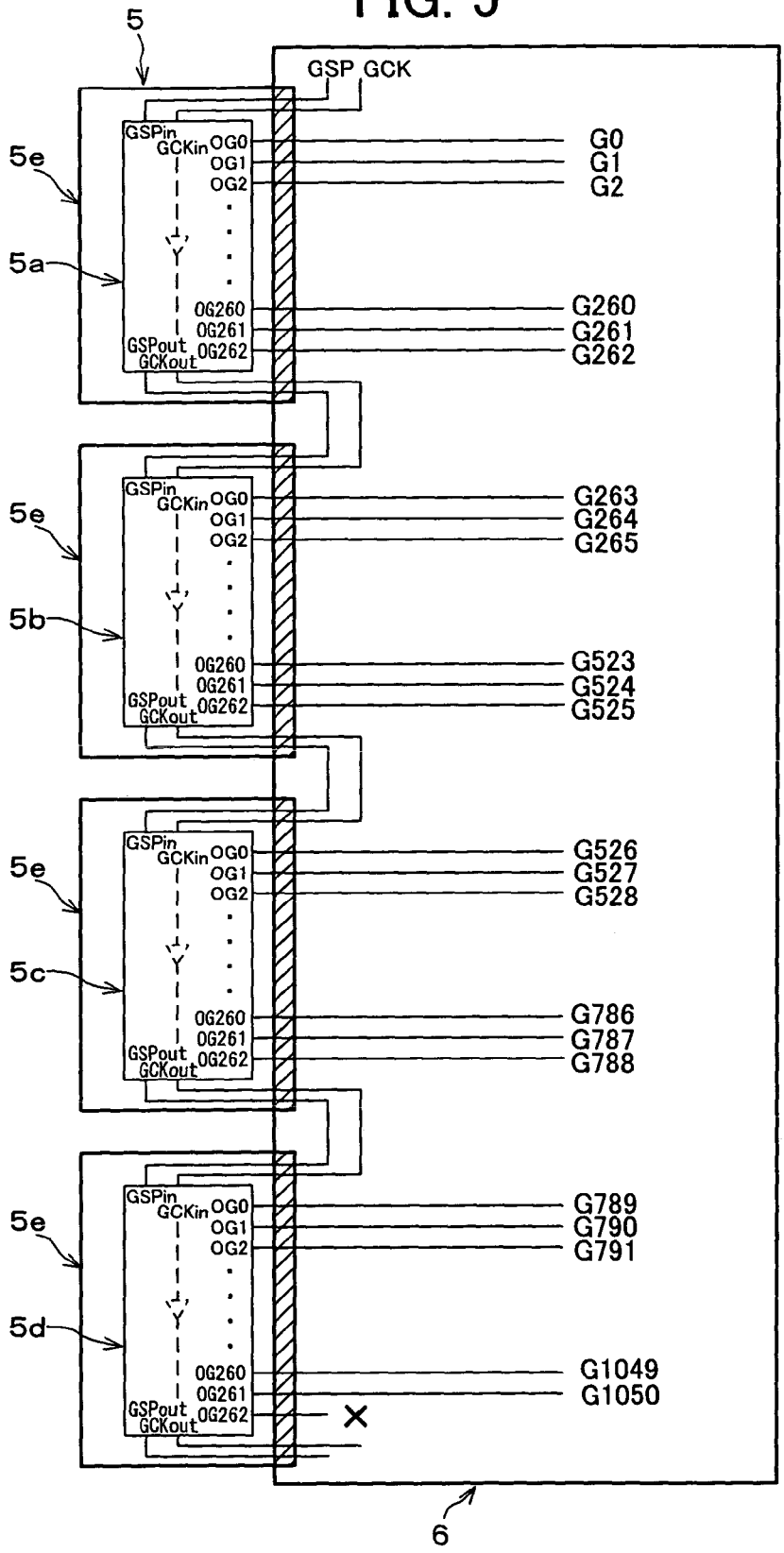
FIG. 5 is a plan view illustrating a gate driver of a liquid crystal display device in accordance with Embodiment 2 of the present invention, and members around the gate driver.
Figure 6:
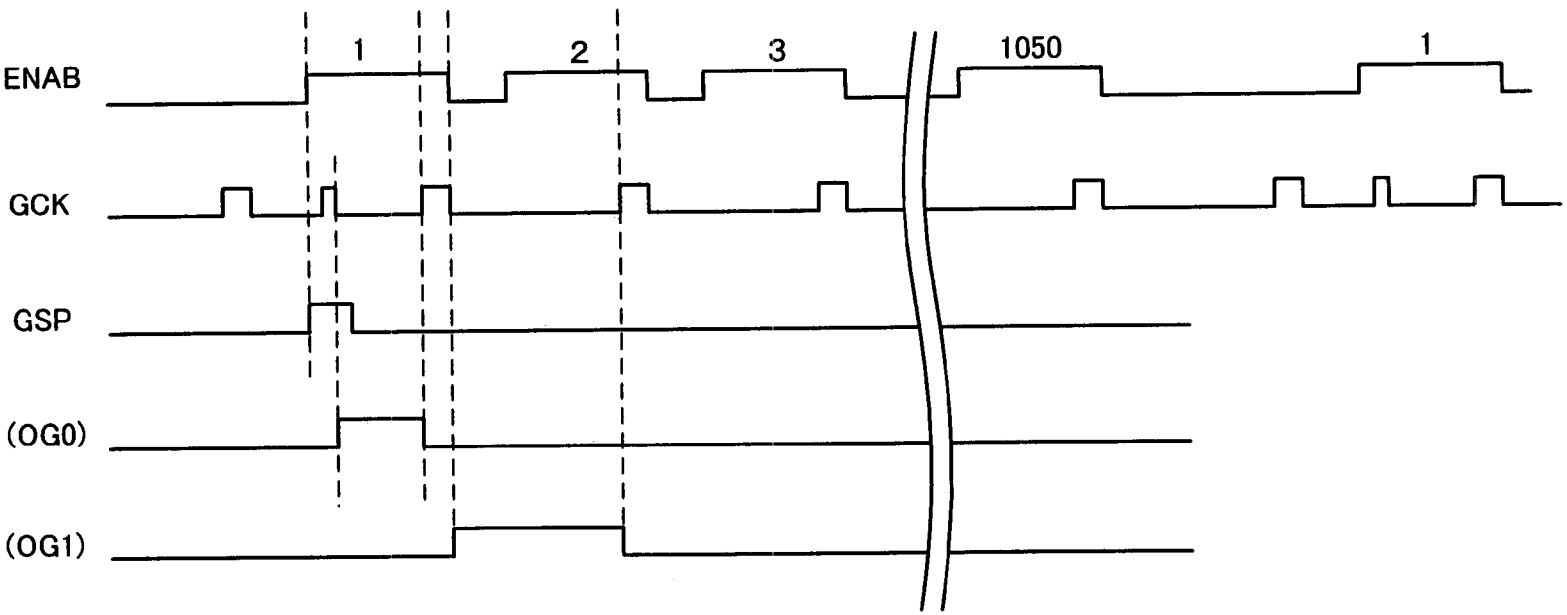
FIG. 6 illustrates timing charts of signals regarding a timing control ASIC of the liquid crystal display device in accordance with Embodiment 2 of the present invention.
Figure 7:
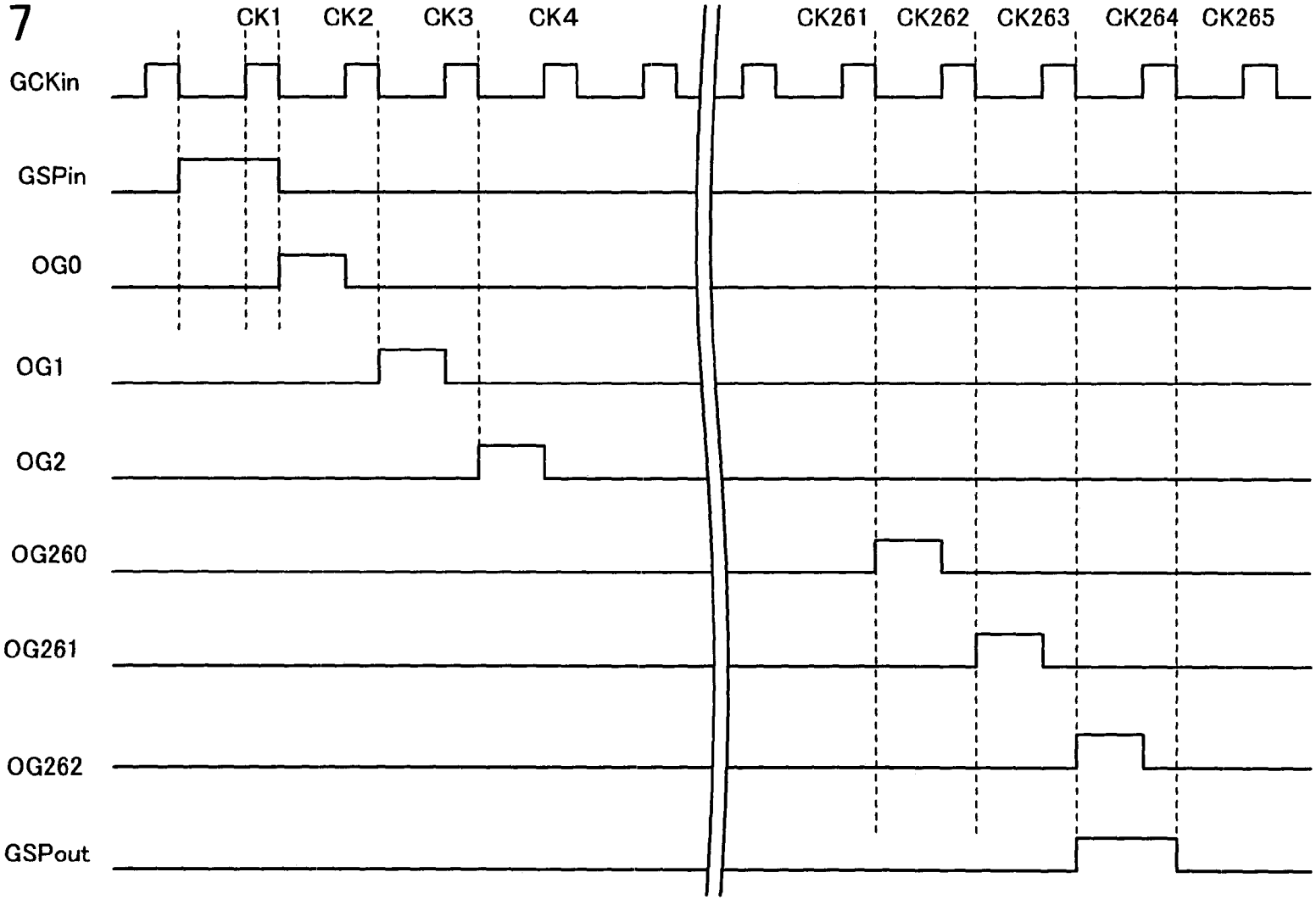
FIG. 7 illustrates timing charts of signals regarding the gate driver in FIG. 5.

The following will describe another embodiment of the present invention with reference to FIGS. 5-7. By the way, members having the same functions as those described in Embodiment 1 are given the same numbers, so that the descriptions are omitted for the sake of convenience.

A liquid crystal display device of the present embodiment is arranged in such a manner that the liquid crystal display device of Embodiment 1 is modified to be an SXGA+ liquid crystal display device with 1400×1050 pixels. In connection with this modification, the liquid crystal display device of the present embodiment is provided with a gate driver 5 and a liquid crystal panel 6 as illustrated in FIG. 5.

The gate driver 5 is arranged in such a manner that driver ICs 5*a*, 5*b*, 5*c*, and 5*d* each having 263 outputs are cascaded and TCP-mounted on respective carrier tapes 5*e* by a TAB method. On the liquid crystal panel 6, a dummy line G0 and gate lines G1, G2, . . . , and G1050 are formed. To these lines, terminals OG0, OG1, . . . , OG262 of each of driver ICs 5*a*, 5*b*, and 5*c* and terminals OG0, OG1, . . . , OG261 of a driver 5*d* are connected. Only a terminal OG262 of the driver IC 5*d* is a dummy terminal.

FIG. 6 illustrates signals of the control IC 1 of the arrangement above. 1050 pulses of a data enable signal ENAB are supplied during one vertical period, and a gate start pulse signal GSP and a gate clock signal GCK are identical with those in FIG. 1. FIG. 7 illustrates signals of the gate driver 5. Sequential drive starting from the terminal OG0 is arranged to be identical with the drive illustrated in FIG. 4, and on the occasion of driving the terminal OG262, the start pulse signal GSP is supplied from a terminal GSPout to the driver IC of the next stage.

That is to say, in the present embodiment, it is possible to adopt conventional gate driver ICs each being able to produce 263 outputs, which are cascaded. Thus, it is unnecessary to adopt a special gate driver IC as in the conventional art 3.

Driver ICs each having 264 or 265 outputs are required in order to drive 1050 gate lines G connected to respective pixels effective for displaying and a dummy line G0 (i.e. to drive 1051 lines), by means of a driver IC in which a terminal OG0 connected to the dummy line G0 is driven after the drive of the last terminal as in the conventional art 3. In contrast, in the liquid crystal display device of the present embodiment, these 1051 lines are driven by the driver ICs 5*a*, 5*b*, 5*c*, and 5*d* being cascaded, having 263×4=1052 terminals for outputting gate signals. Thus, the number of dummy output terminals is fewer than the case of the conventional art, and this makes it possible to easily reduce and optimize the size of the IC chip and reduce the costs.

Embodiment 3

Figure 8:
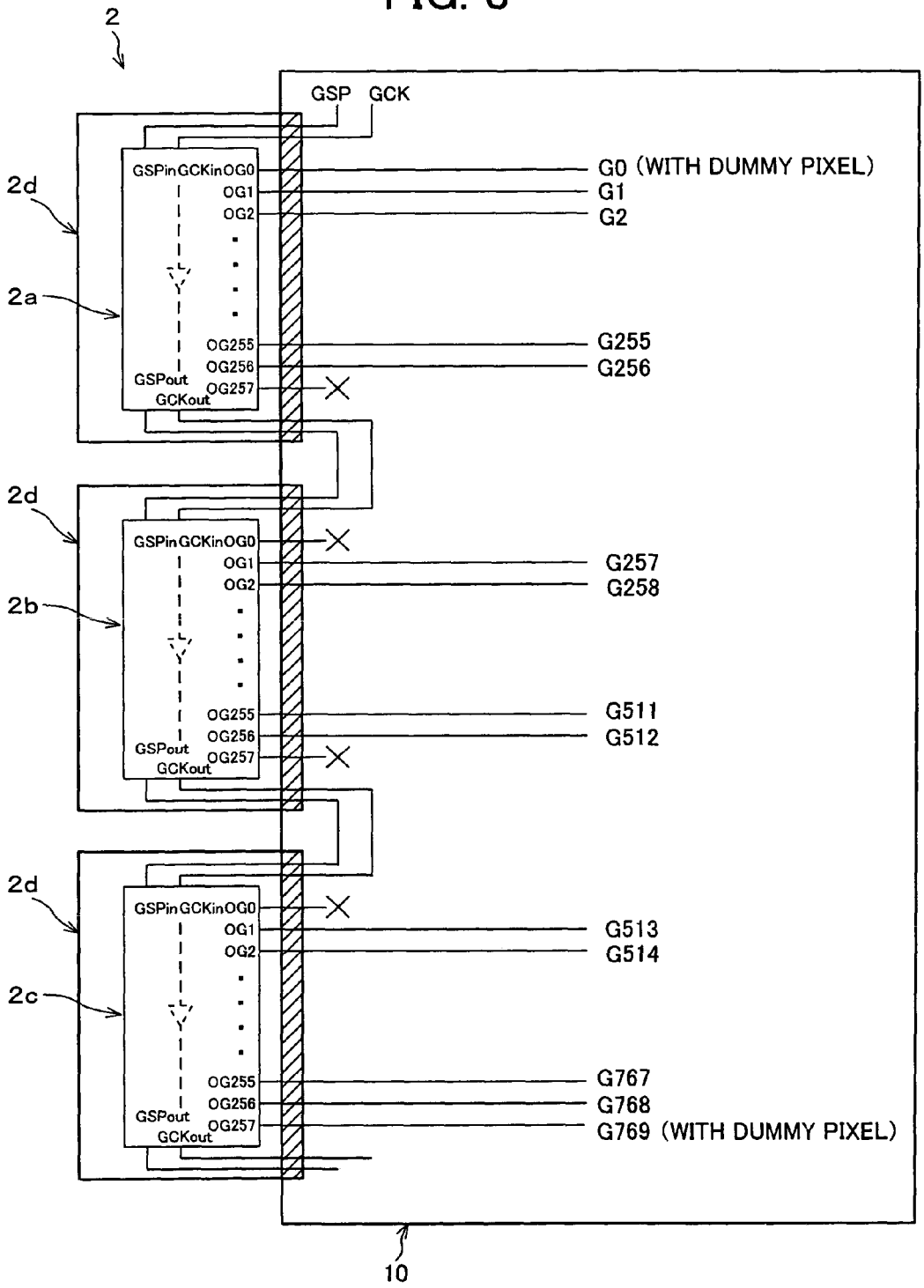
FIG. 8 is a plan view illustrating a gate driver of a liquid crystal display device in accordance with Third Embodiment of the present invention, and members around the gate driver.
Figure 9:
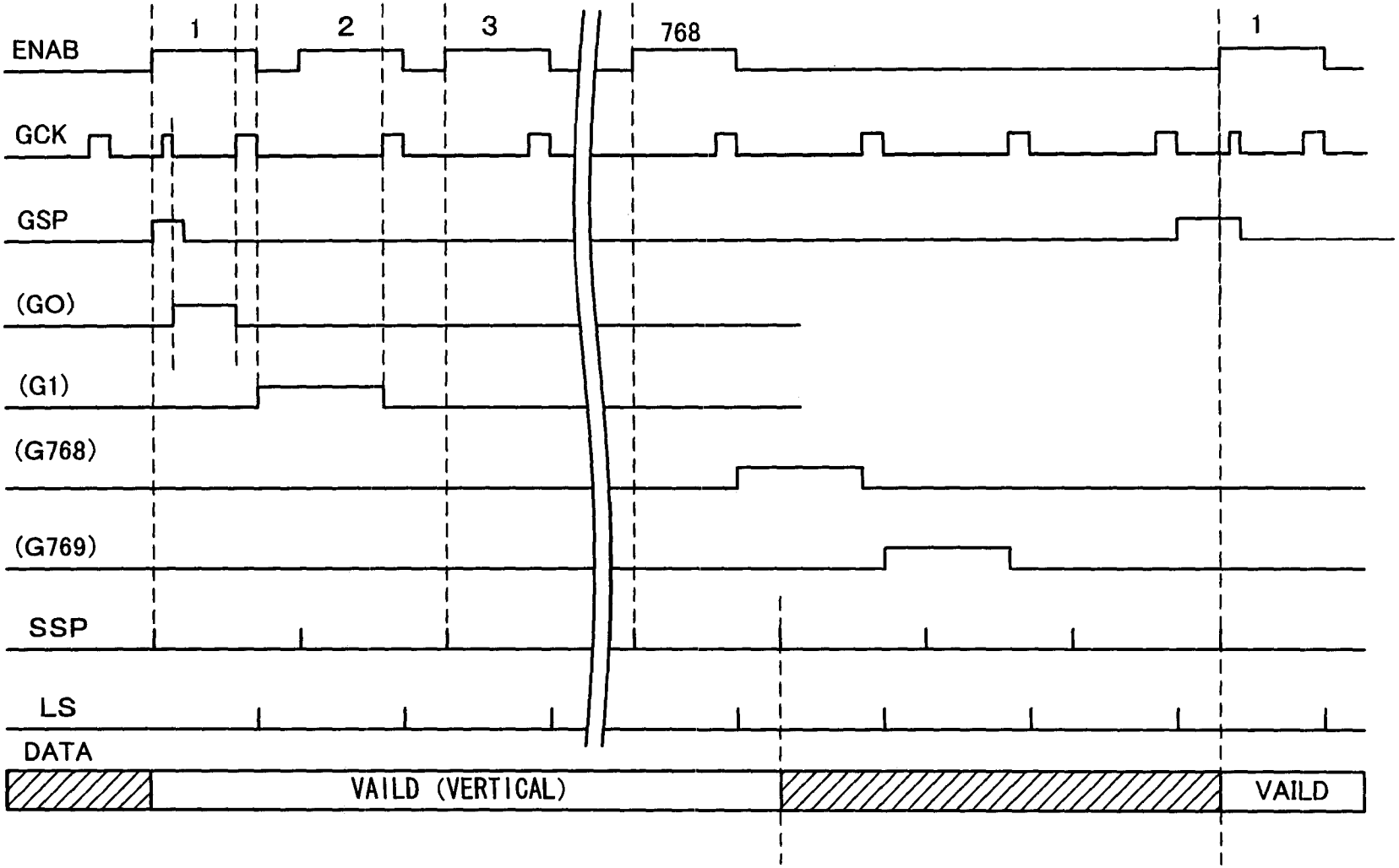
FIG. 9 illustrates timing charts of signals regarding a timing control ASIC of the liquid crystal display device in accordance with Third Embodiment of the present invention.

The following will describe a further embodiment of the present invention with reference to FIGS. 8 and 9. By the way, members having the same functions as those described in Embodiments 1 and 2 are given the same numbers, so that the descriptions are omitted for the sake of convenience.

As illustrated in FIG. 8, a liquid crystal display device of the present embodiment is identical with the liquid crystal display device of Embodiment 1, except that a liquid crystal panel 10 includes dummy lines G0 and G769 each having a dummy pixel, which are respectively provided before the first effective pixel and after the last effective pixel, for the sake of improving long-term reliability of the panel.

In the method of driving the dummy line G0 having been described as the conventional art 3, the display data of the gate line G257 is supplied to the dummy pixel connected to the dummy line G0. For this reason, when sets of display data such as moving image data, which are different from frame to frame, are displayed, an opposing DC voltage level of the dummy pixel connected to the dummy line G0 is unstable.

In contrast, in a method of driving the dummy line G0 of the present embodiment, it is possible to output sampled display data at a timing of diving the dummy line G0, during a vertical return period indicated as an area with oblique lines in FIG. 9. With this arrangement, it is possible to supply a stable voltage to a pixel.

Further, the image data sampled during the vertical return period is, for instance, white data when a normally while panel is adopted, or black data when a normally black panel is adopted.

Embodiment 4

Figure 10:
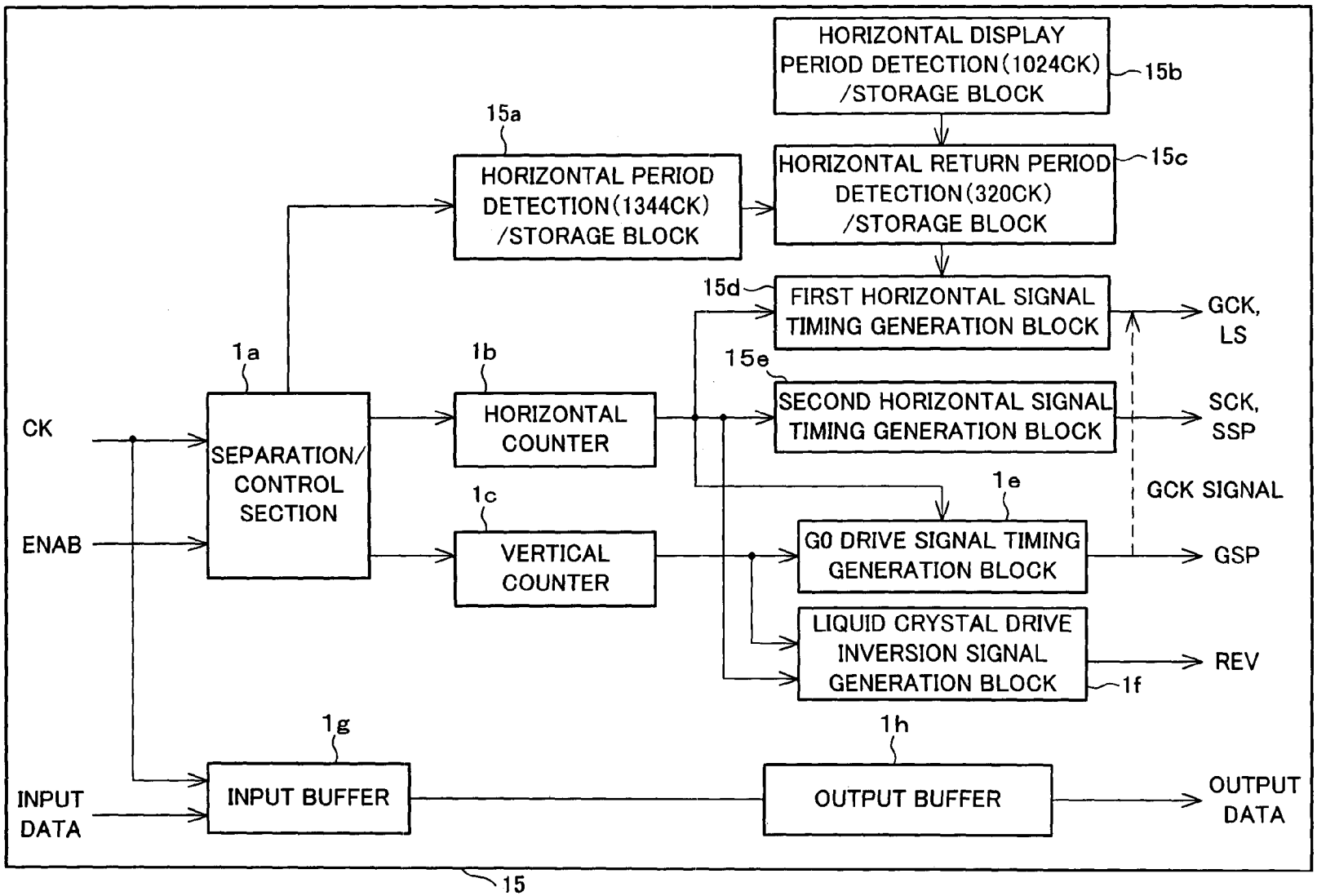
FIG. 10 is a block diagram illustrating an arrangement of a timing control ASIC of a liquid crystal display devise in accordance with Fourth Embodiment of the present invention.
Figure 11:
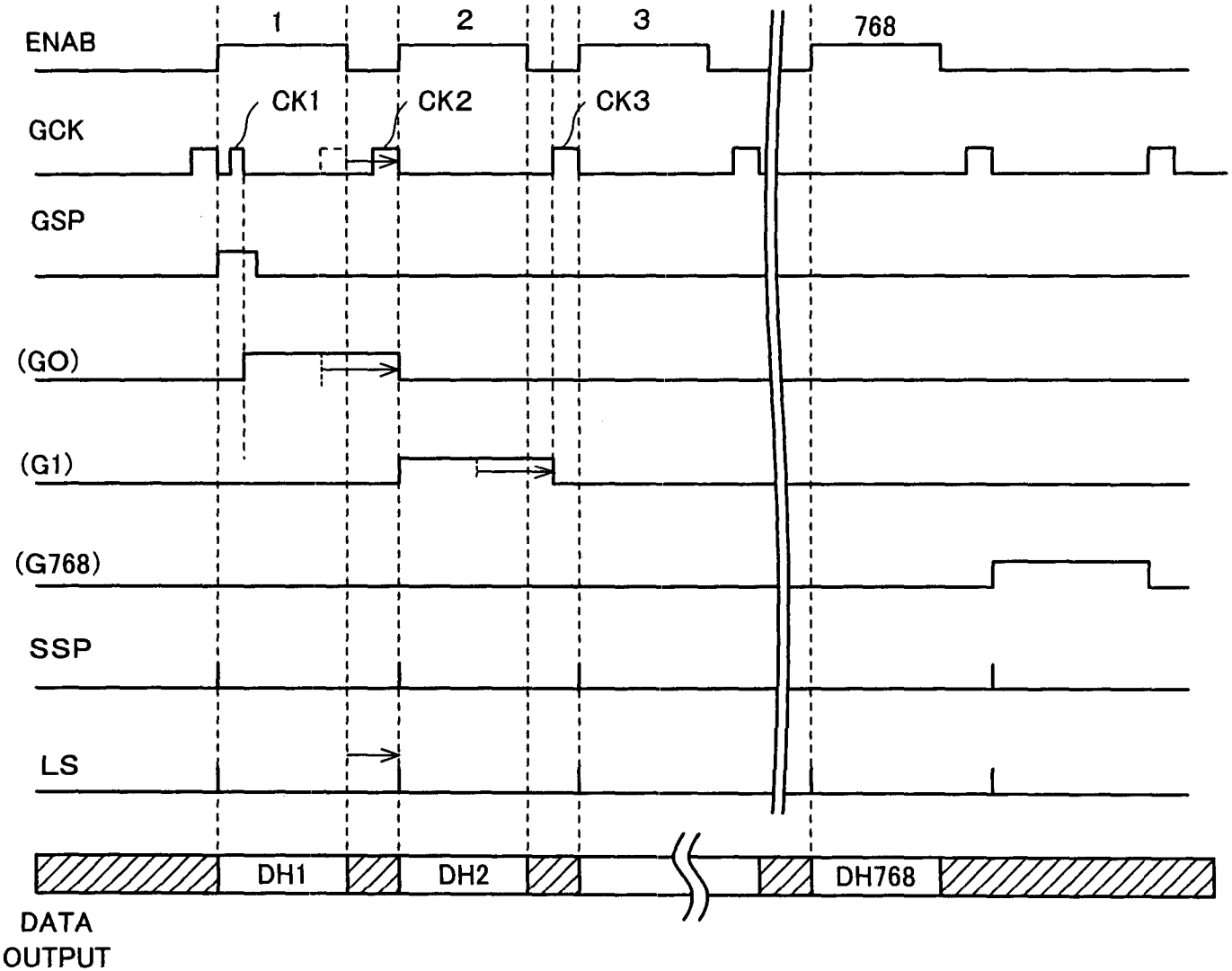
FIG. 11 illustrates timing charts of signals regarding the timing control ASIC of the liquid crystal display device in accordance with Fourth Embodiment of the present invention.

The following will describe yet another embodiment of the present invention with reference to FIGS. 10 and 11. By the way, members having the same functions as those described in Embodiments 1-3 are given the same numbers, so that the descriptions are omitted for the sake of convenience.

A liquid crystal display device in accordance with the present embodiment includes a circuit inside a control IC, which memorizes the number of clocks in one horizontal period. Using this circuit, the timings of outputting a gate clock signal GCK and a latch strobe signal LS, which become liquid crystal drive timing signals, are delayed. With this arrangement, the drive period of the dummy line G0 is caused to be identical with the drive periods of other gate lines G.

FIG. 10 illustrates a control IC 15 of the present embodiment. This control IC (control device) 15 includes a separation/control section 1*a*, a horizontal counter 1*b*, a vertical counter 1*c*, a G0 drive signal timing generation block 1*e*, a liquid crystal drive inversion signal generation block 1*f*, an input buffer 1*g*, an output buffer 1*h*, a horizontal period detection/storage block 15*a*, a horizontal display period detection/storage block 15*b*, a horizontal return period detection/storage block 15*c*, a first horizontal signal timing generation block 15*d*, and a second horizontal signal timing generation block 15*e*.

The horizontal period detection/storage block 15*a* counts the clocks of a clock signal CK from the timing of inputting a data enable signal ENAB, and memorizes the counted clocks. Then the horizontal period detection/storage block 15*a* performs outputting which indicates the timing of the end of one horizontal period (e.g. for 1344 clocks). The horizontal display period detection/storage block 15*b* counts the clocks of the clock signal CK from the timing of the input of the data enable signal ENAB, and memorizes the counted clocks. Then the horizontal display period detection/storage block 15*b* perform outputting which indicates the timing of the end of a period (e.g. for 1024 clocks) of writing write signals into pixels in one horizontal period. The horizontal return period detection/storage block 15*c* recognizes the timing of the start of a horizontal return period, from the timing of the end of the writing period indicated by the horizontal display period detection/storage block 15*b*. Then the horizontal return period detection/storage block 15*c* recognizes the timing of the end of the horizontal return period (e.g. for 320 clocks), from the timing of the end of one horizontal period indicated by the horizontal period detection/storage block 15*a*.

The first horizontal signal timing generation block 15*d* generates a gate clock signal GCK and a latch strobe signal LS from the result of the counting by the horizontal counter 1*b* and the timings of the start and end of the horizontal return period indicated by the horizontal return period detection/storage block 15*c*, and outputs the generated signals. On this occasion, as illustrated in FIG. 11, pulses CK2, CK3, . . . of the gate clock signal GCK are generated so as to fall during the horizontal return period, in this case fall at the timing of the end of the horizontal return period. Then the latch strobe signal LS is generated at the timing of inputting the next data enable signal ENAB to the control IC 15. With this arrangement, the drive period of the dummy line G0 is extended as much as the horizontal return period from the end of the drive period in Embodiment 1 to the timing of the input of the next data enable signal ENAB to the control IC 15. On this account, it is possible to cause the drive period of the dummy line G0 to be identical with the drive periods of the remaining gate lines G. Accordingly, the timing of the start of the writing into the pixel is delayed. This delay of the timing is indicated by an arrow in FIG. 11.

The second horizontal signal timing generation block 15*e* generates a source clock signal SCK and a source start pulse signal SSP from the result of the counting by the horizontal counter 1*b*, and outputs the generated signals.

With the arrangement above, it is possible to extend the drive period of the dummy line G0 by means of a small modification of the logic of the control IC, without subjecting the display data to processes such as retardation.

This arrangement can be adopted to a pixel structure such as CS ON GATE in which a voltage variation ΔV2 by a parasitic capacitance is large.

Embodiment 5

Figure 12:
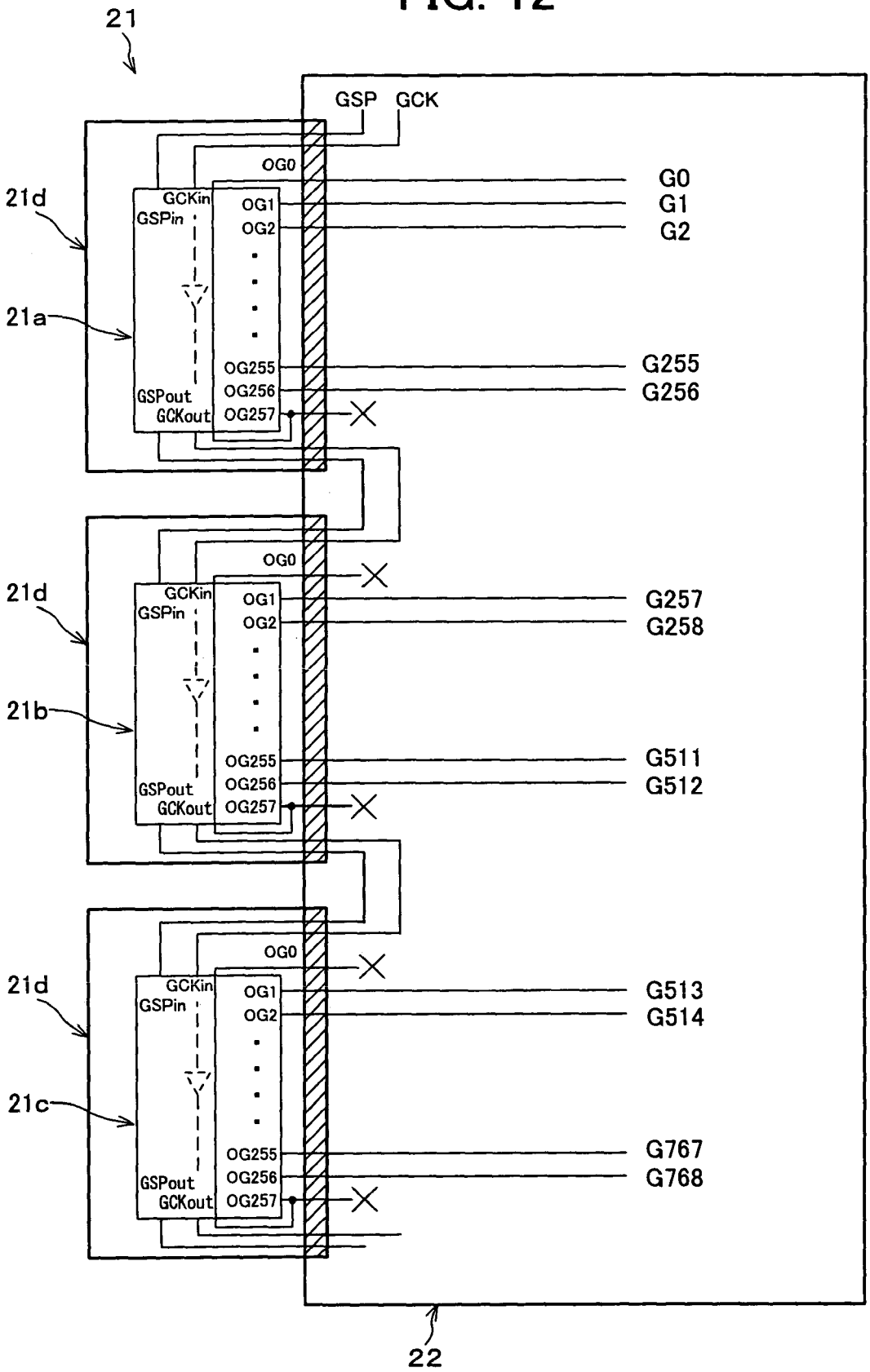
FIG. 12 is a plan view illustrating a gate driver of a liquid crystal display device in accordance with Fifth Embodiment of the present invention, and members around the gate drivers.
Figure 14:
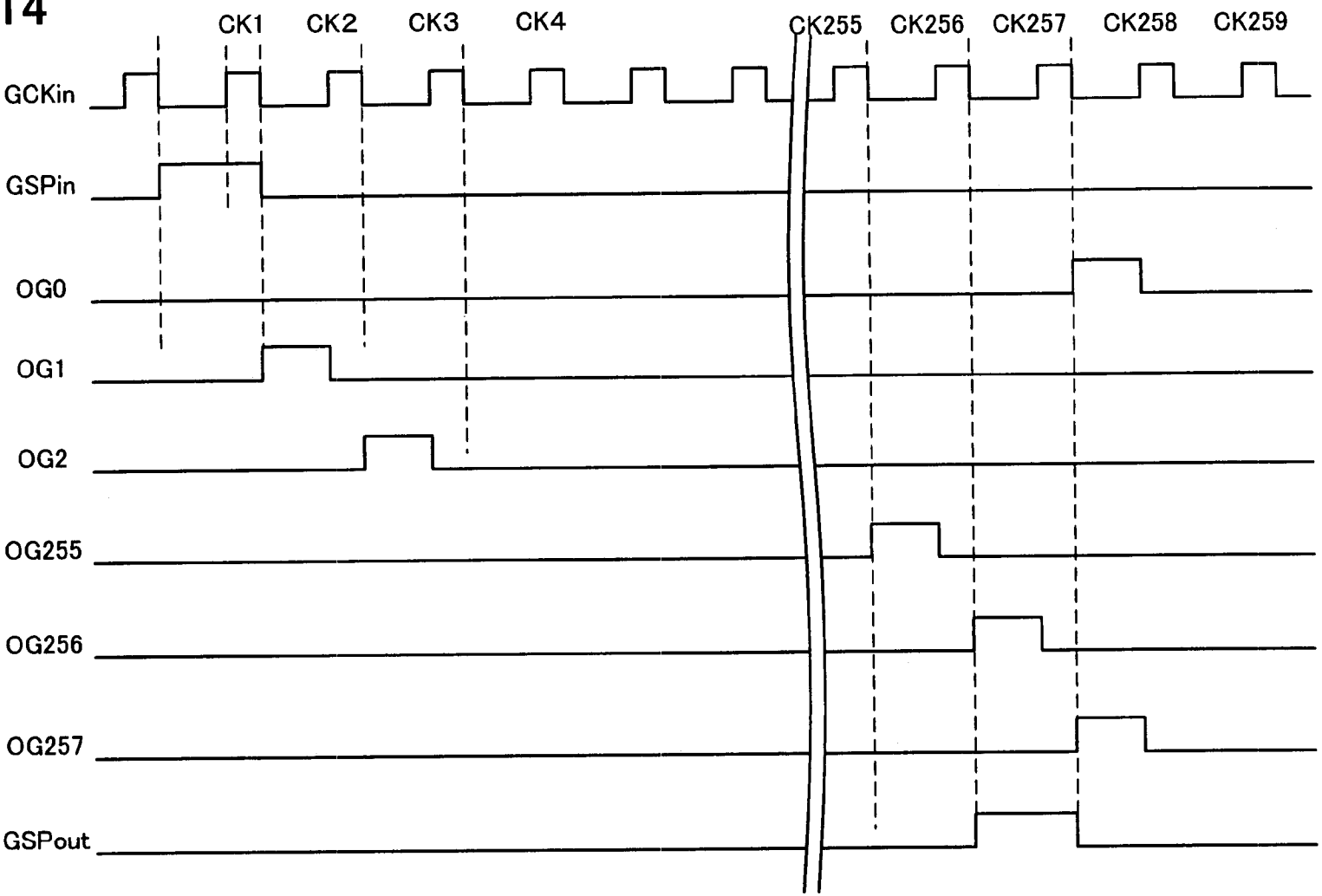
FIG. 14 illustrates timing charts of signals regarding the gate driver in FIG. 12.

The following will describe still another embodiment of the present invention with reference to FIGS. 12 and 14. By the way, members having the same functions as those described in Embodiments 1-4 are given the same numbers, so that the descriptions are omitted for the sake of convenience.

Figure 28:
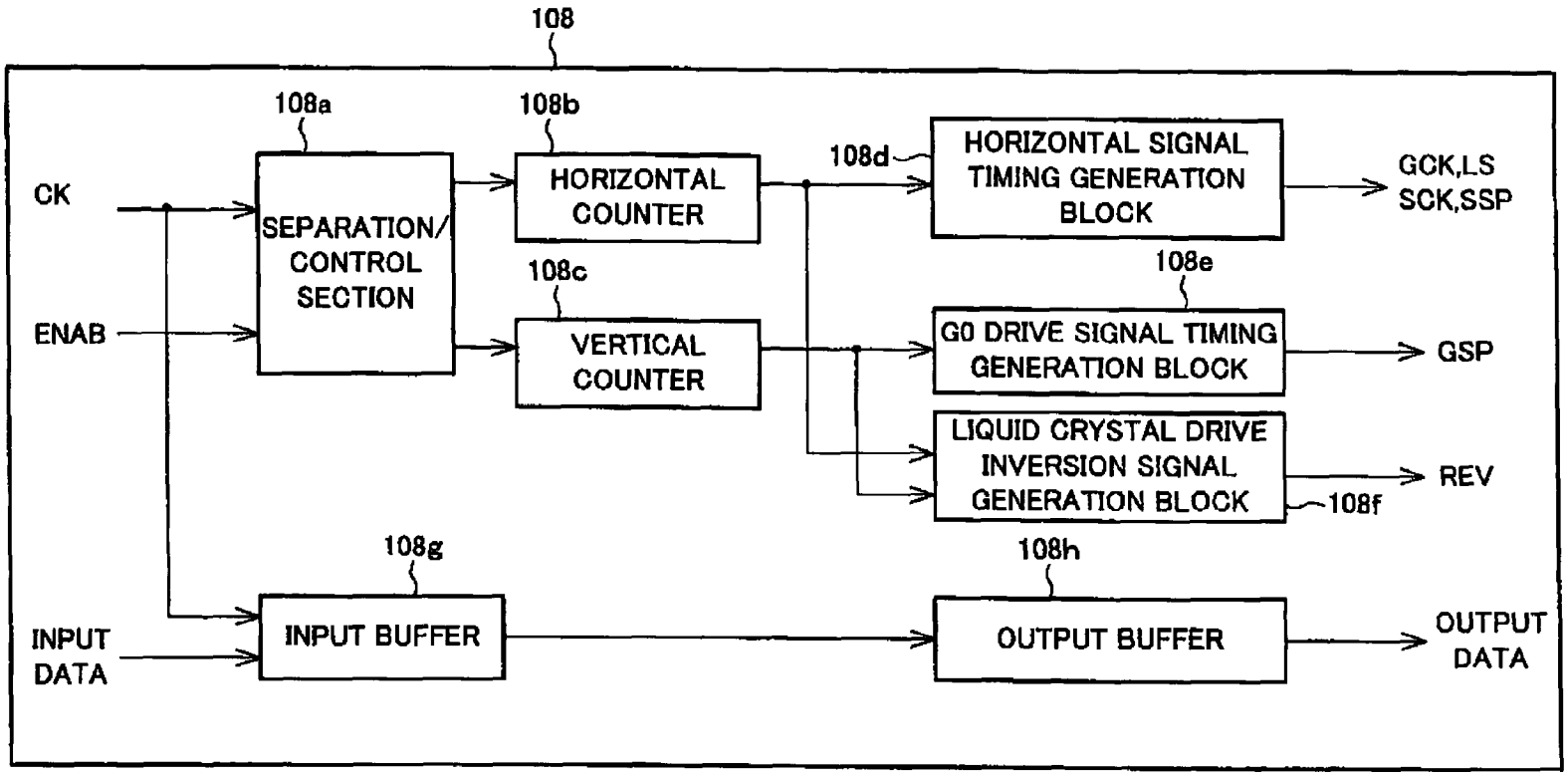
FIG. 28 (PRIOR ART)
FIG. 28 is a block diagram, illustrating a timing control ASIC of the conventional liquid crystal display device.
Figure 29:
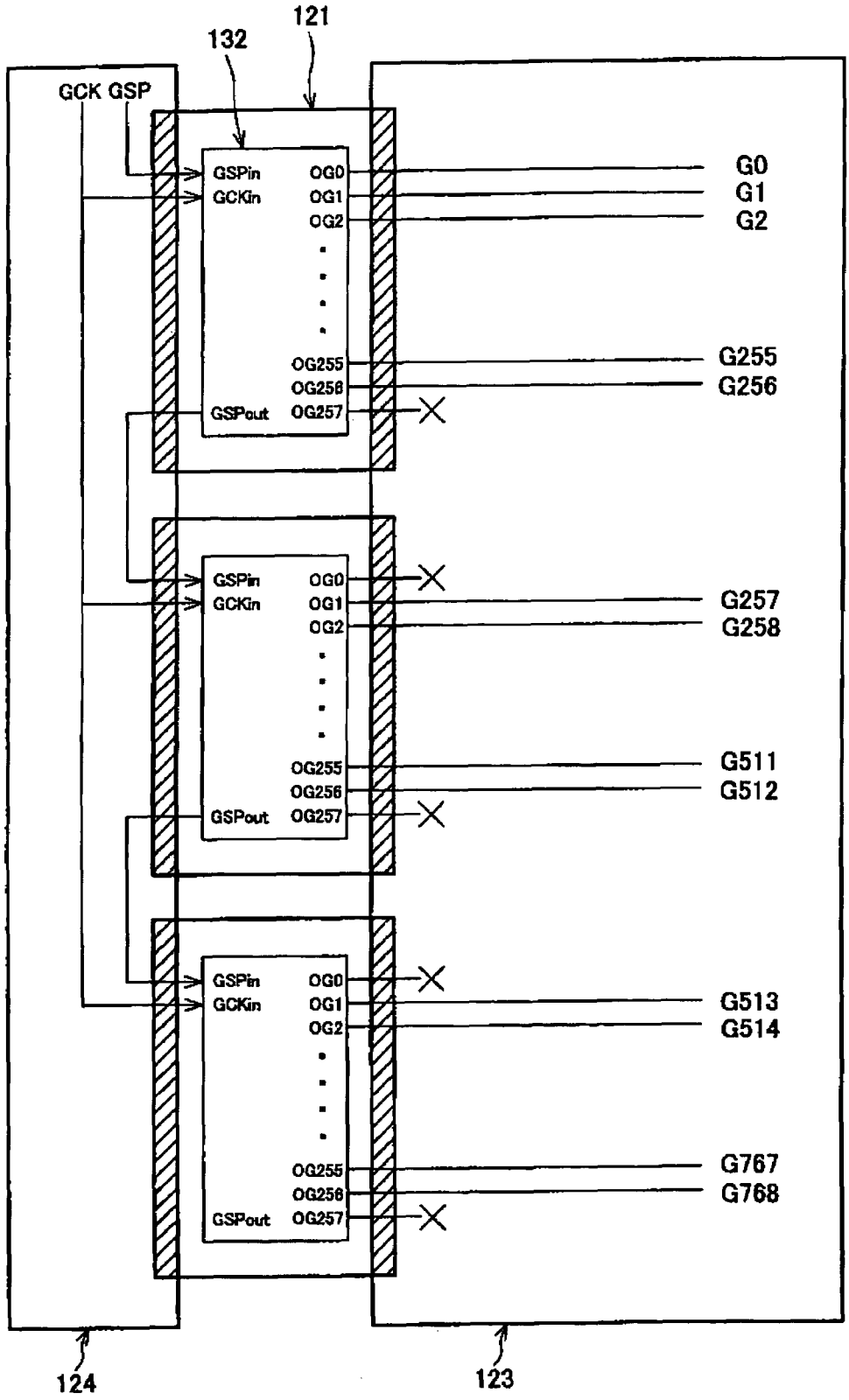
FIG. 29 (PRIOR ART)
FIG. 29 is a plan view of a fourth arrangement of the gate driver of the conventional liquid crystal display device, and members around the gate driver.
Figure 30:
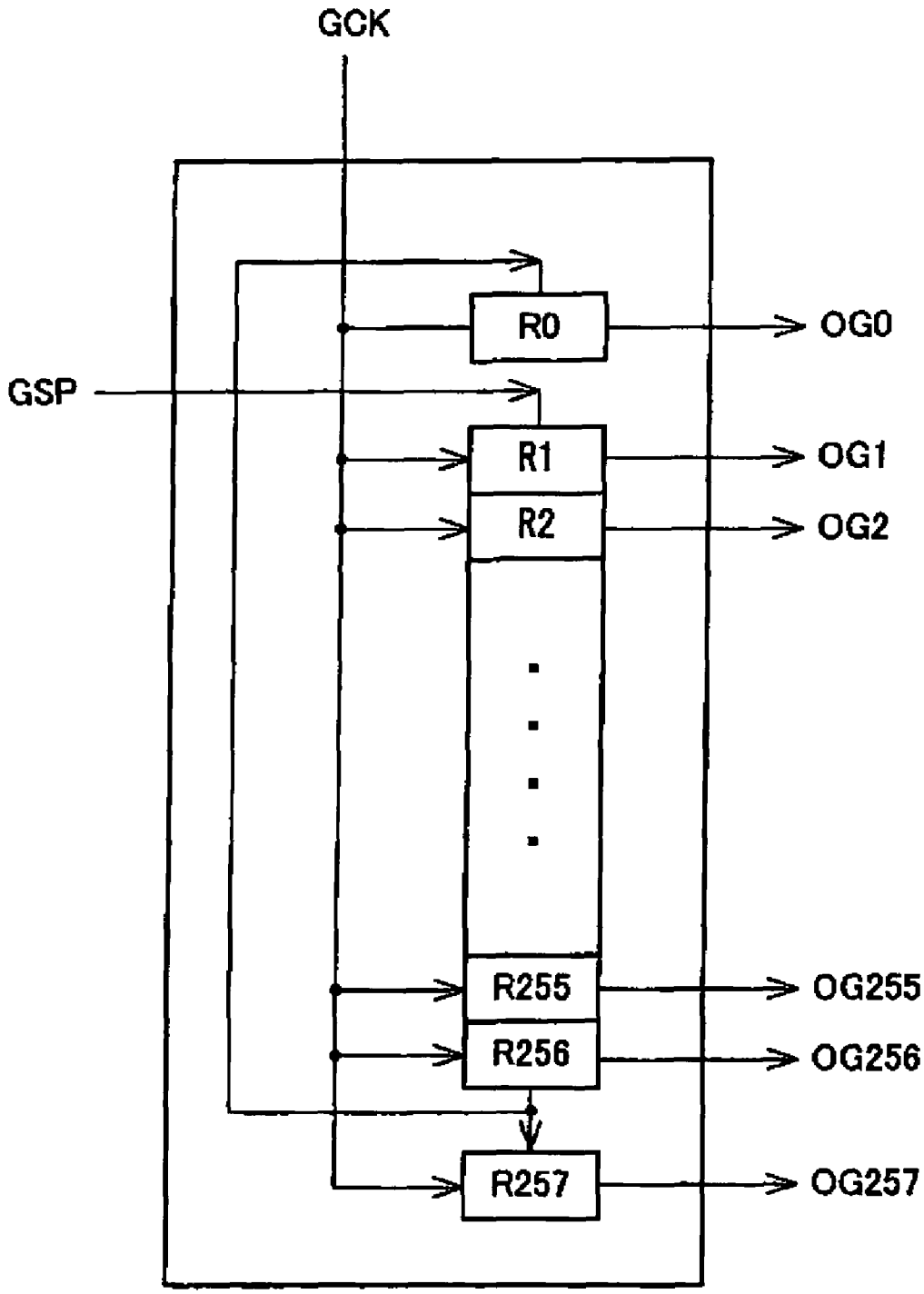
FIG. 30 (PRIOR ART)
FIG. 30 is a block diagram, illustrating the internal arrangement of one of driver ICs of the gate driver in FIG. 29.
Figure 31:
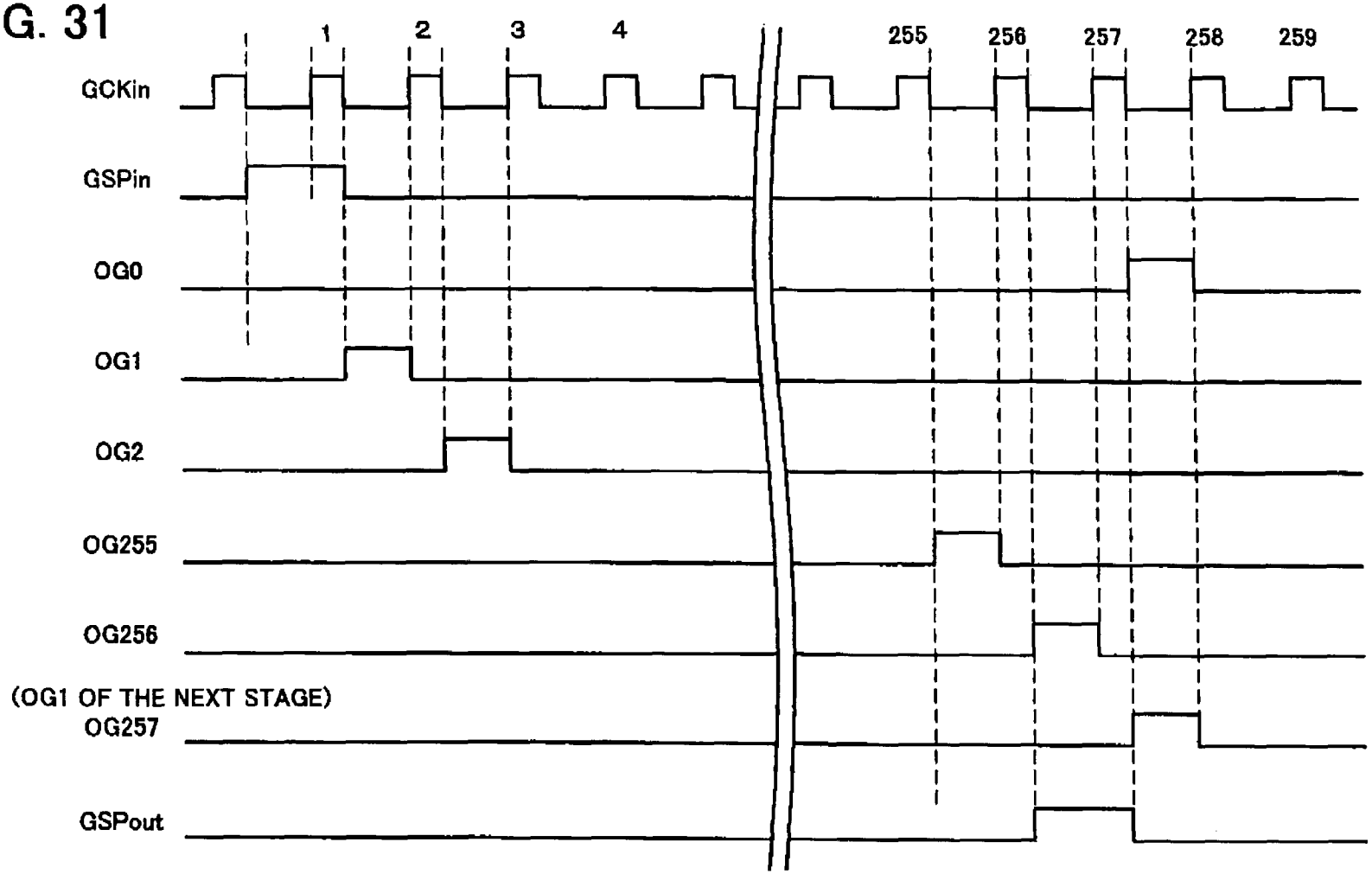
(PRIOR ART) FIG. 31
FIG. 31 illustrates timing charts of signals regarding the gate driver in FIG. 30.

A liquid crystal display device of the present embodiment is arranged in such a manner that a dummy line G0 is driven using an SOF (System On Film) structure. In this connection, as illustrated in FIG. 12, the liquid crystal display device of the present embodiment is provided with a gate driver 21 and a liquid crystal panel 22. Also, a control IC 108 illustrated in FIG. 28 is adopted.

The gate driver 21 is arranged such that driver ICs 21*a*, 21*b*, and 21*c* each having terminals OG1-OG257 are cascaded and SOF-mounted on respective films 21*d*. To the terminal OG257 of the driver IC 21*a*, i.e. to the terminal next to the terminal OG256 corresponding to the last gate line G256 of the driver IC 21*a*, a line passing under the driver IC 21*a* is connected. This line, (i) connected to the terminal OG0 which is an output terminal of the film 21*d* and (ii) provided before the gate line G1 corresponding to the top effective pixel, is the dummy line G0. The driver ICs 21*b* and 21*c* are also arranged in an identical manner. Note that, the terminal OG0 is a dummy terminal.

With this arrangement, in the driver IC 21*a*, gate signals are outputted in the order of the terminals OG1→OG2→ . . . →OG256→OG0.

Figure 13:
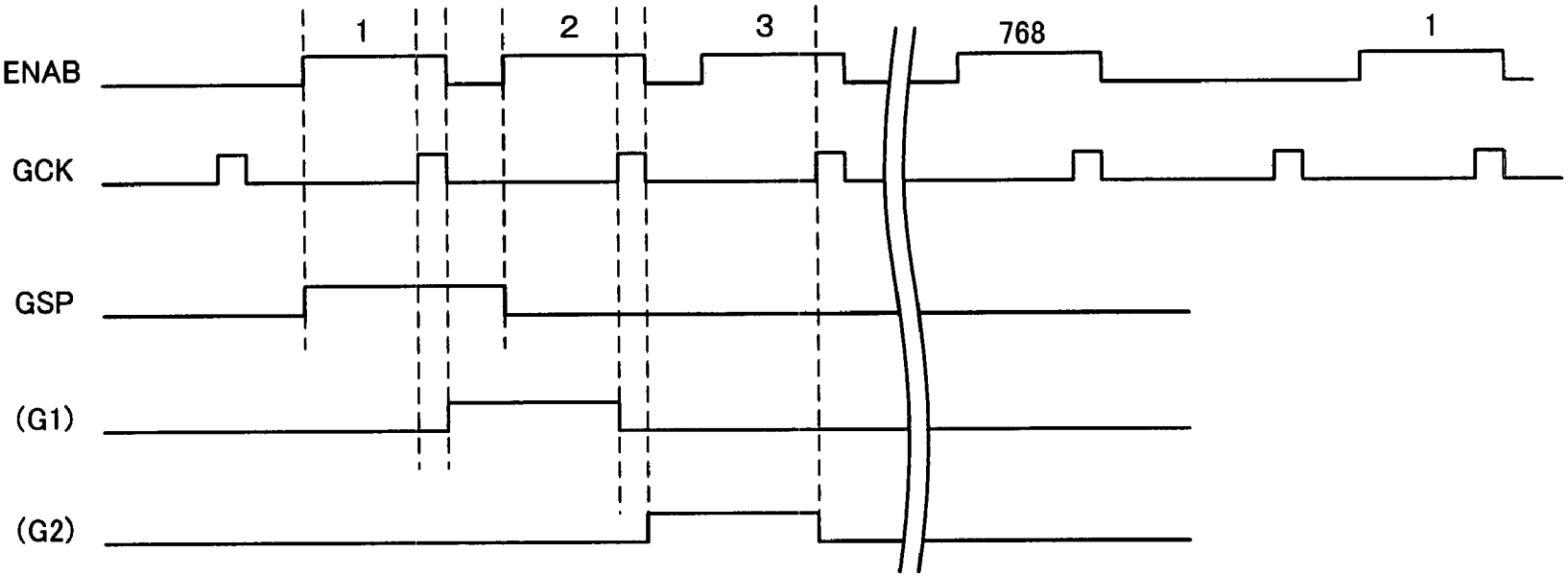
FIG. 13 illustrates timing charts of signals regarding a timing control ASIC of the liquid crystal display device in accordance with Fifth Embodiment of the present invention.

FIG. 13 illustrates signals of the control IC 108. Since the dummy line G0 drives after the drive of the gate line G256, it is not necessary to generate a gate start pulse signal GSP and a gate clock signal GCK which are for driving the dummy line G0 in the first place, as in the cases of Embodiments 1-4. For this reason, a gate start pulse signal GSP and a gate clock signal GCK in the present embodiment are normal signals for driving the gate lines from the gate line G1. FIG. 14 illustrates signals of the gate driver 21. Simultaneously with the driving of the terminal OG256 of the driver IC 21*a*, the gate start pulse signal GSP is supplied from a terminal GSPout to the driver IC 21*b* of the next stage, so that the dummy line G0 and the gate line G257 are simultaneously driven.

According to the present embodiment, it is possible to provide a dummy line G0, even if a printed board for the wiring to the gate driver 21 is not provided outside of the liquid crystal panel 22. Further, the dummy line G0 is driven after the drive of the gate lines in the order of the terminals of the driver IC 21*a*. Thus, to perform displaying in the V-ENAB mode, it is unnecessary to drive the dummy line G0 before the drive of the remaining gate lines G. On this account, as the driver ICs 21*a*, 21*b*, and 21*c*, conventional driver ICs each of which drives gate lines in the order of its output terminals. Further, as the driver IC of the present embodiment has the terminal OG257, it is possible to obtain a drive waveform identical with that of the conventional art 3, by adopting a conventional gate driver IC with an increased number of terminals.

As described above, it is possible to perform displaying in a mode that the display timing is controlled by a data enable signal, by adopting, as a row drive circuit for driving rows of a display panel in which a dummy row line is provided on the top of the panel, a drive circuit constituted by conventional driver ICs (i) which are wired on the condition that a printed board is not provided outside a display panel and (ii) in each of which output terminals are driven in the order identical with the order of providing the output terminals.

Embodiment 6

Figure 15:
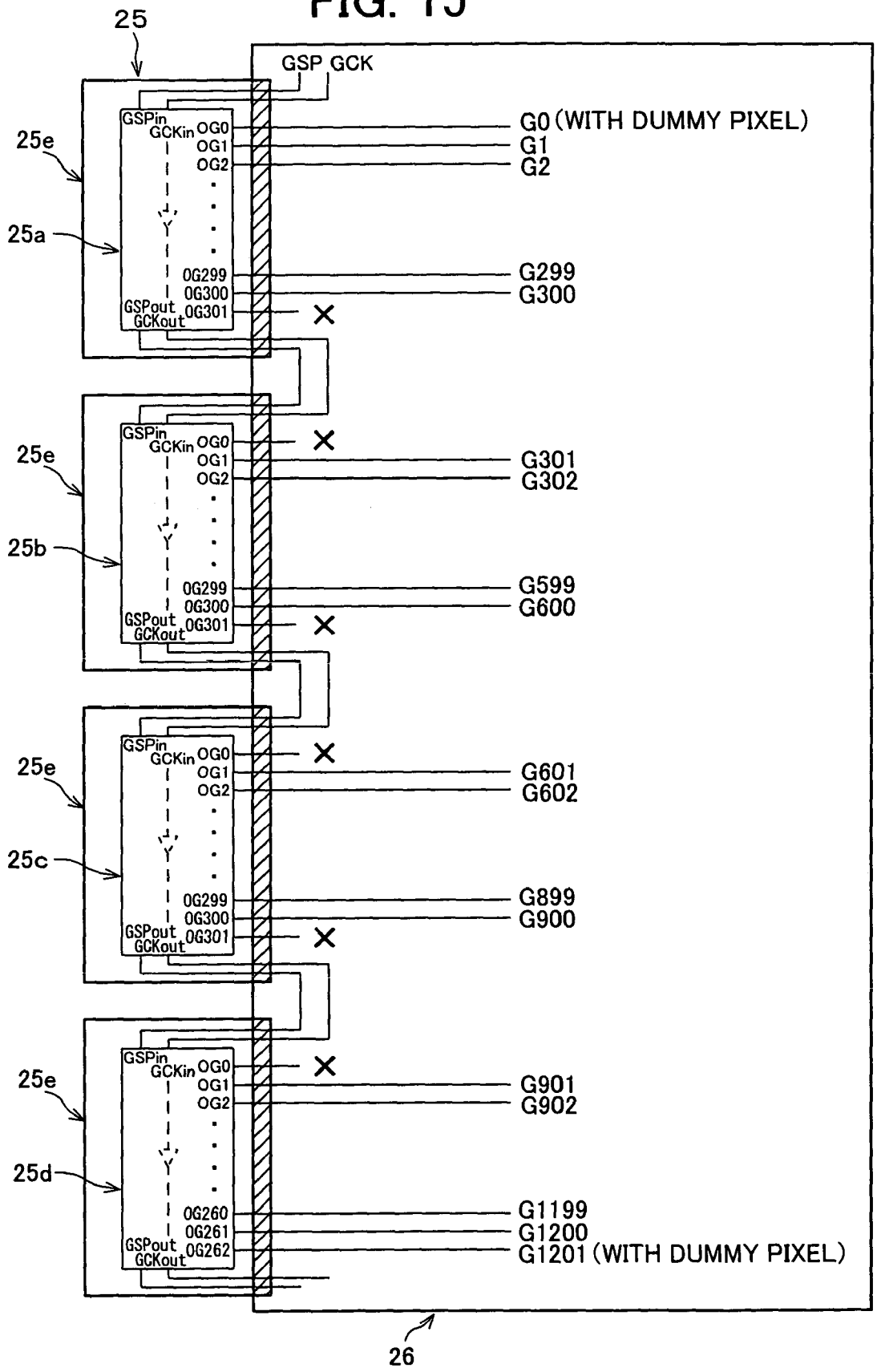
FIG. 15 is a plan view illustrating a gate driver of a liquid crystal display device in accordance with Sixth Embodiment of the present invention, and members around the gate driver.
Figure 17:
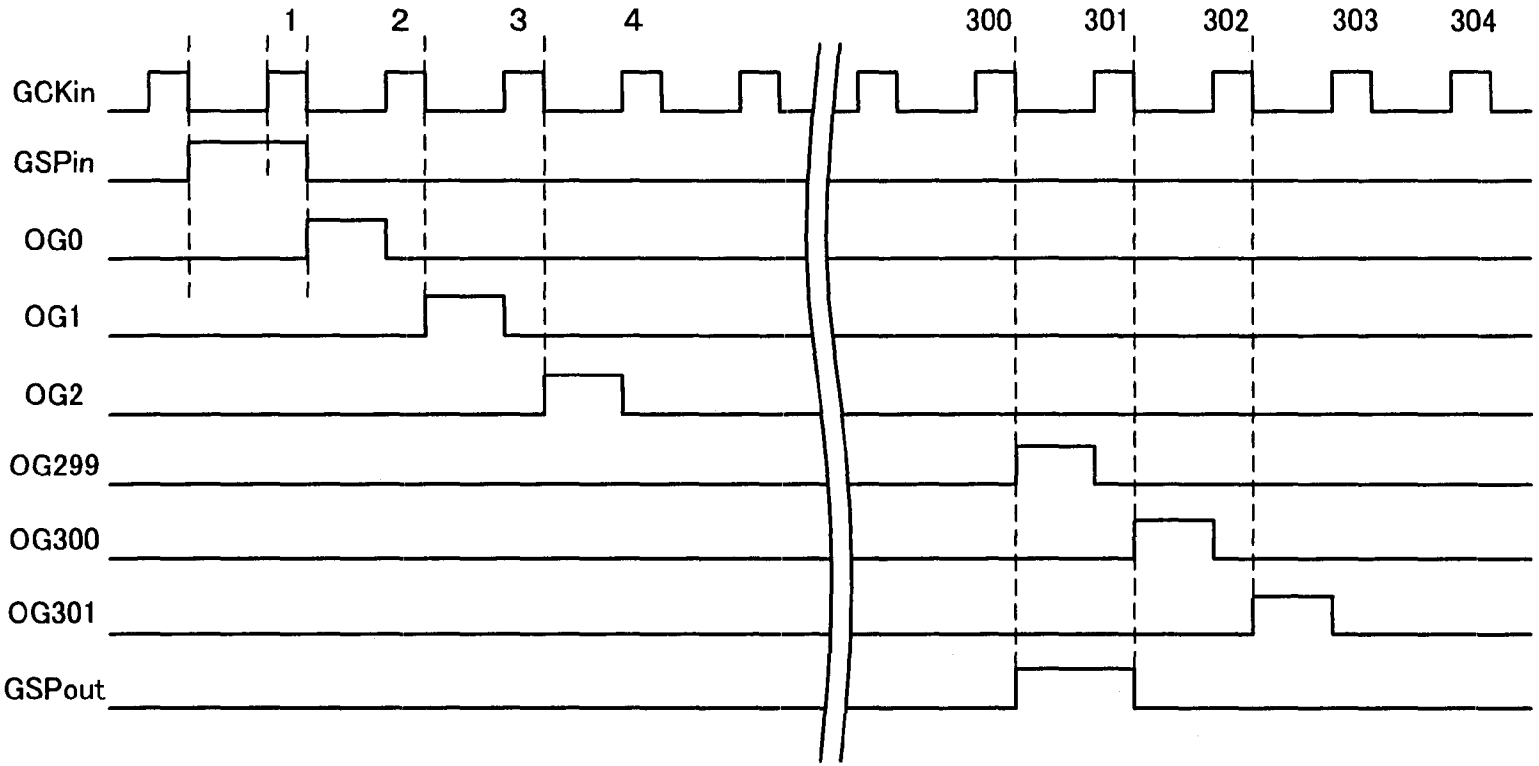
FIG. 17 illustrates timing charts of signals regarding the gate driver in FIG. 15.
Figure 18:
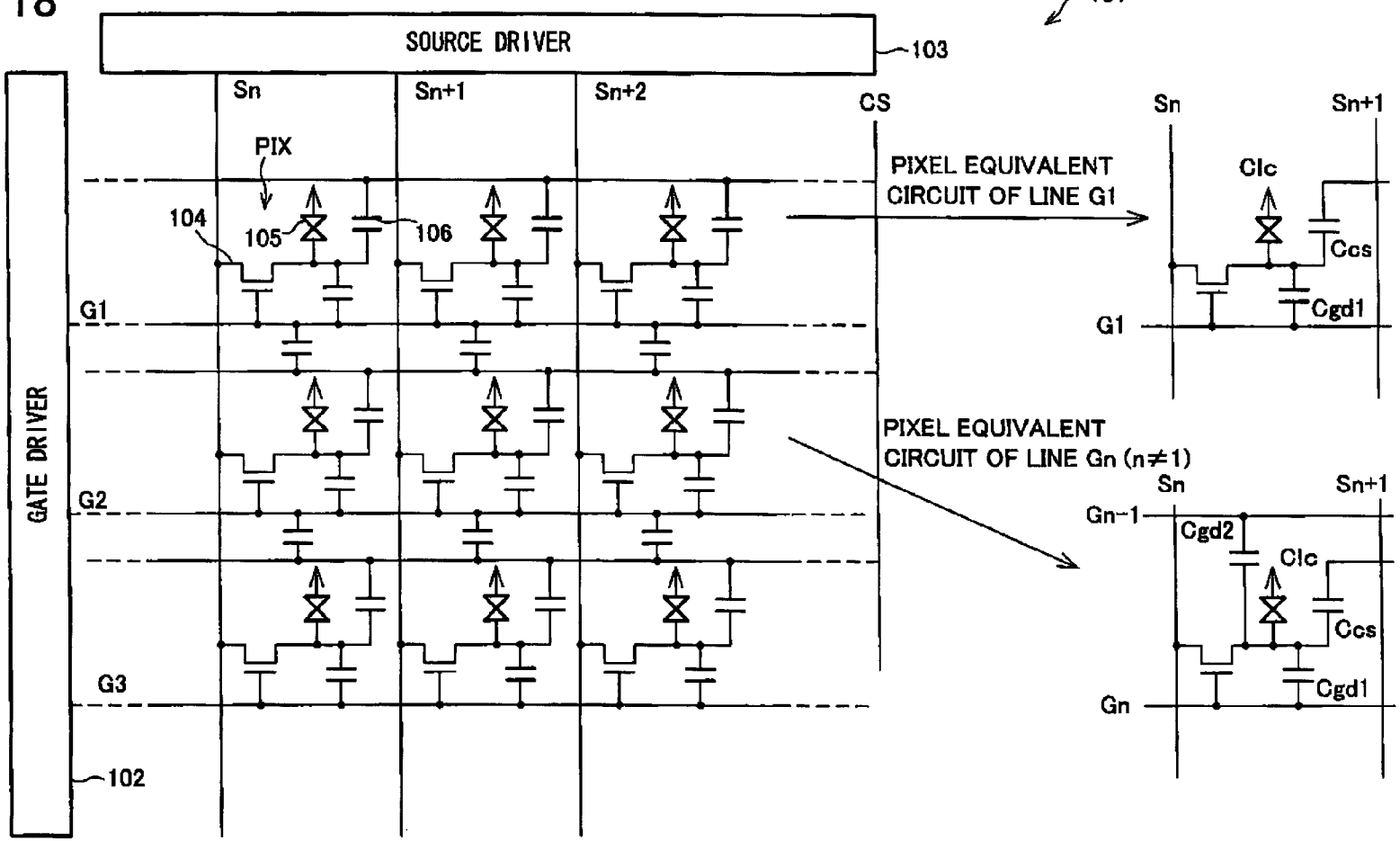
(PRIOR ART) FIG. 18
FIG. 18 illustrates a circuit block diagram illustrating an arrangement of a conventional liquid crystal display device.
Figure 19:
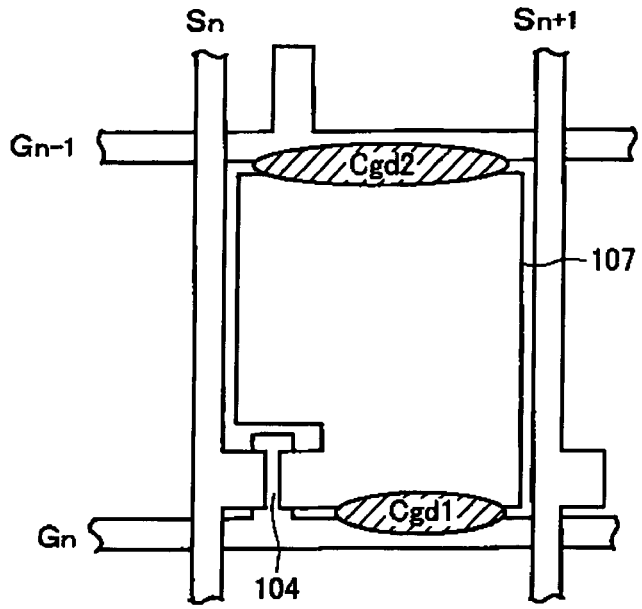
FIG. 19 (PRIOR ART)
FIG. 19 is a plan view of a pixel, illustrating generation of a parasitic capacitance in the liquid crystal display device in FIG. 18.
Figure 20:
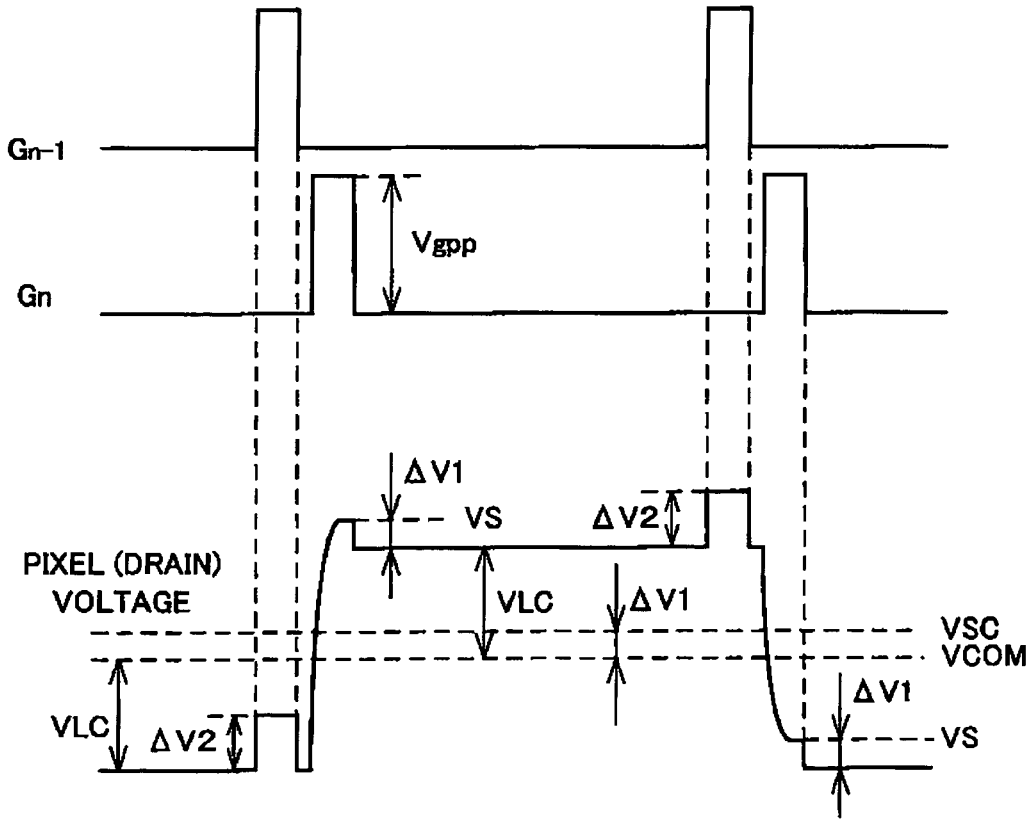
FIG. 20 (PRIOR ART)
FIG. 20 illustrates voltage waveform charts for describing the variation of a pixel electrode voltage caused by the parasitic capacitance in FIG. 18.
Figure 21:
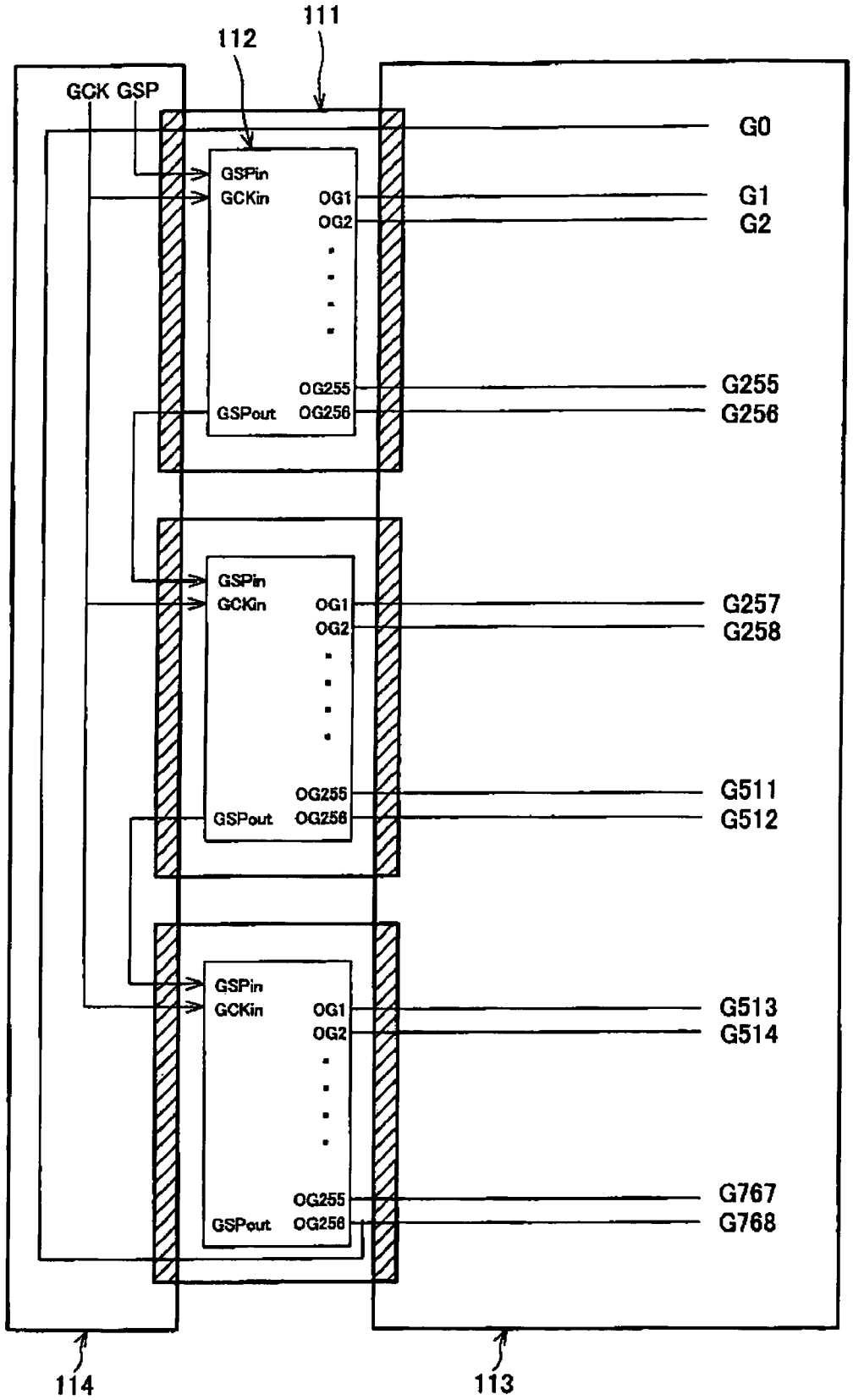
FIG. 21 (PRIOR ART)
FIG. 21 is a plan view of a first arrangement of a gate driver of a conventional liquid crystal display device, and members around the gate drivers.
Figure 22:
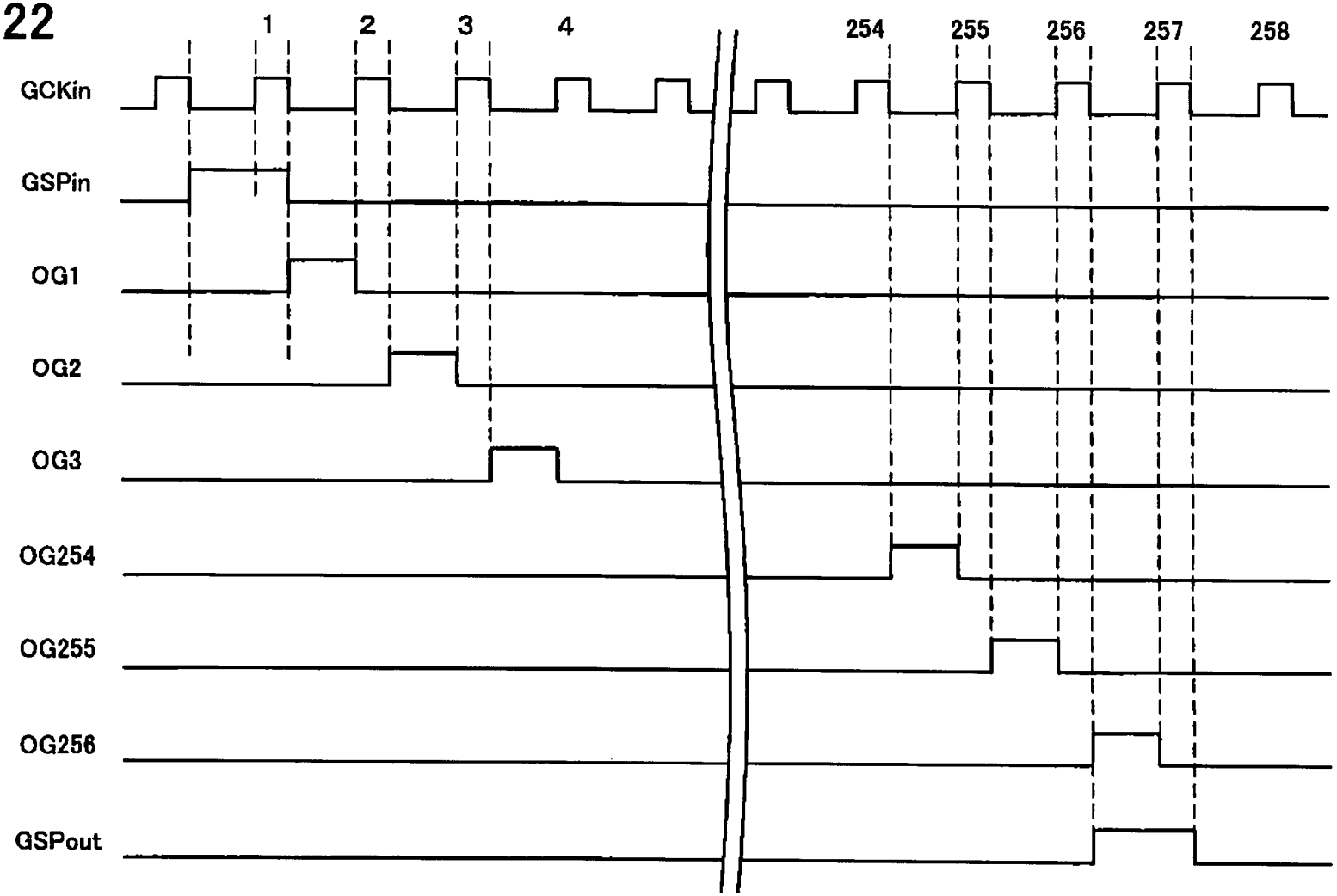
(PRIOR ART) FIG. 22
FIG. 22 illustrates timing charts of signals regarding the gate driver in FIG. 21.
Figure 23:
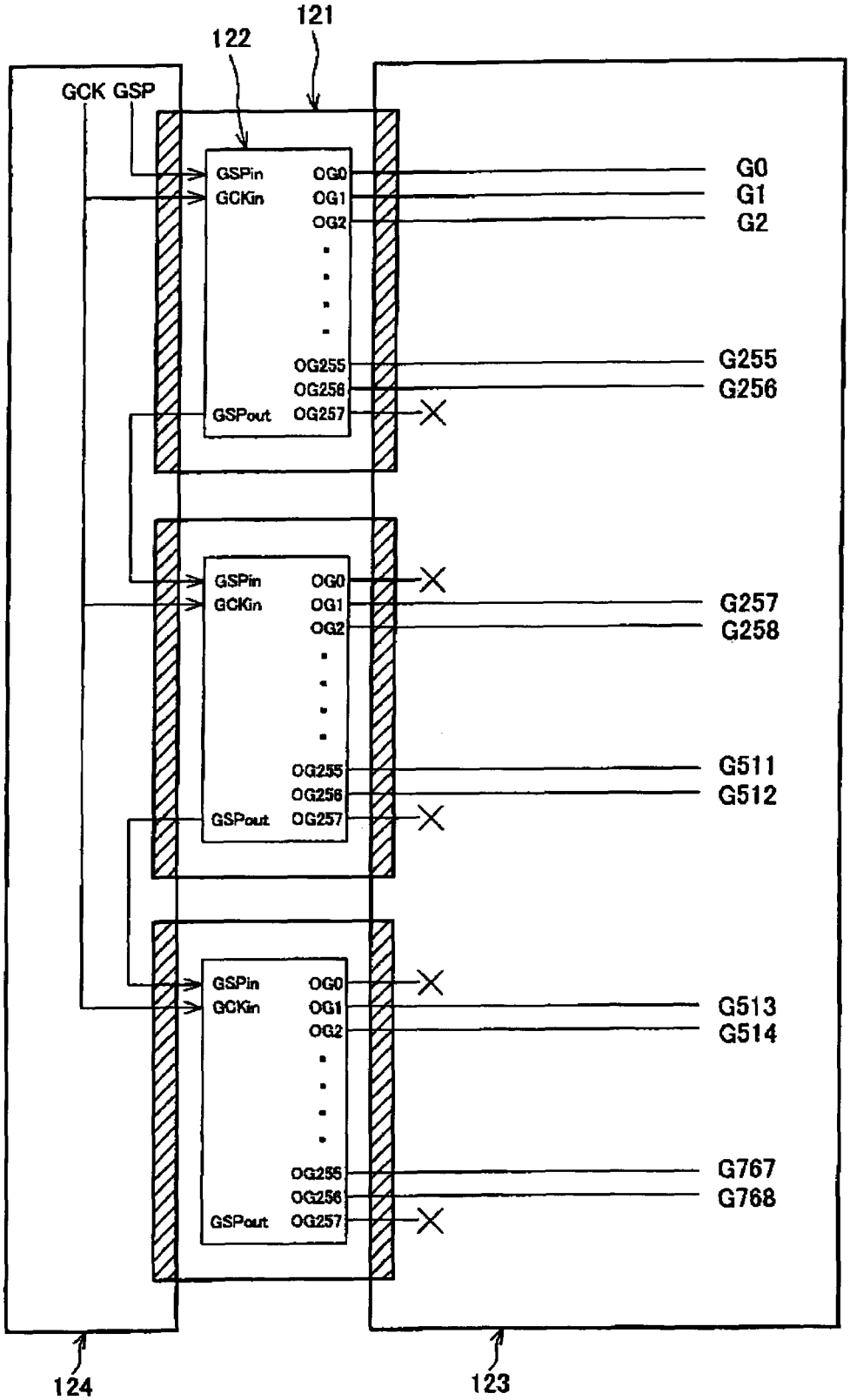
FIG. 23 (PRIOR ART)
FIG. 23 is a plan view of a second arrangement of the gate driver of the conventional liquid crystal display device, and members around the gate driver.
Figure 24:
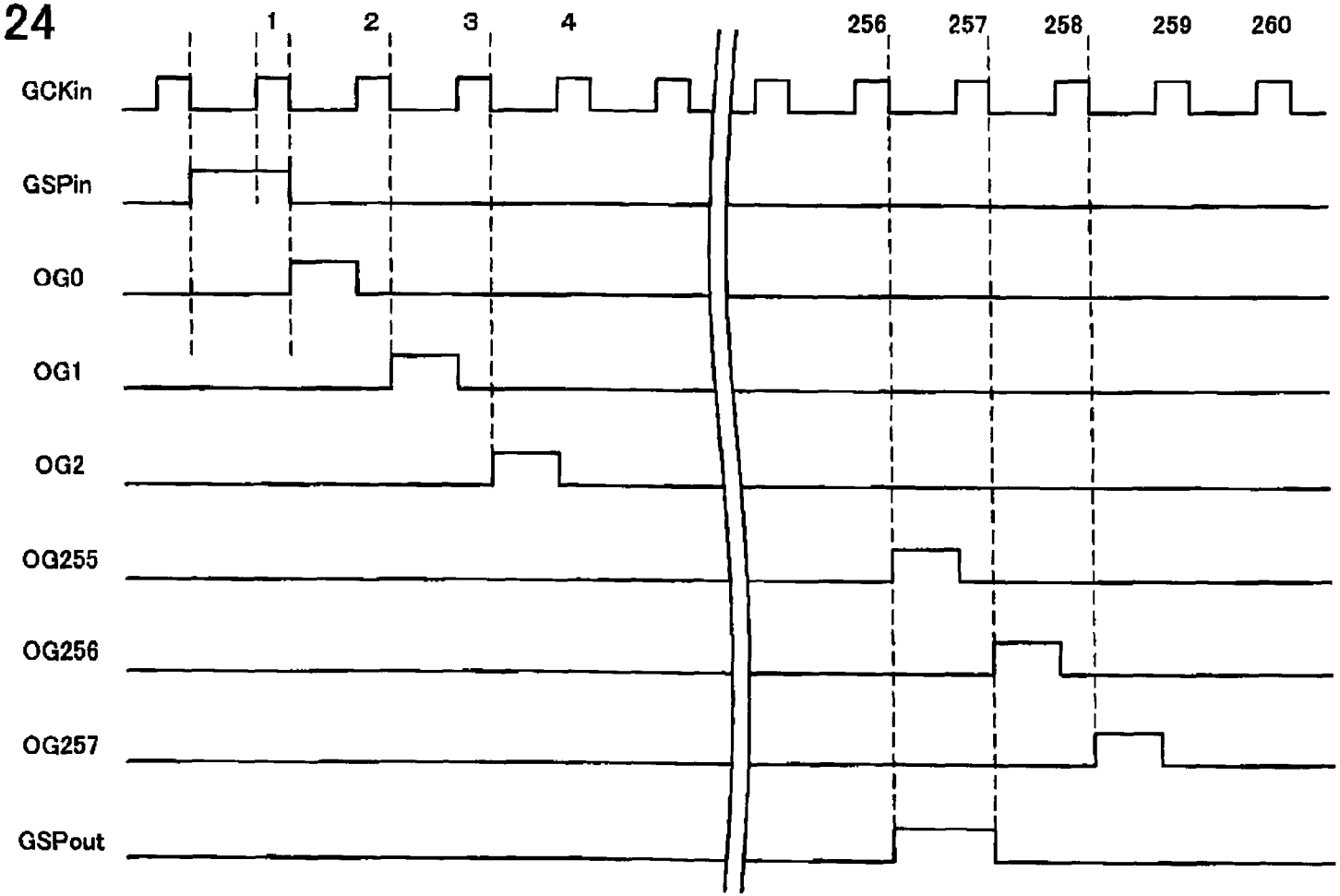
(PRIOR ART) FIG. 24
FIG. 24 illustrates timing charts of signals regarding the gate driver in FIG. 23.
Figure 25:
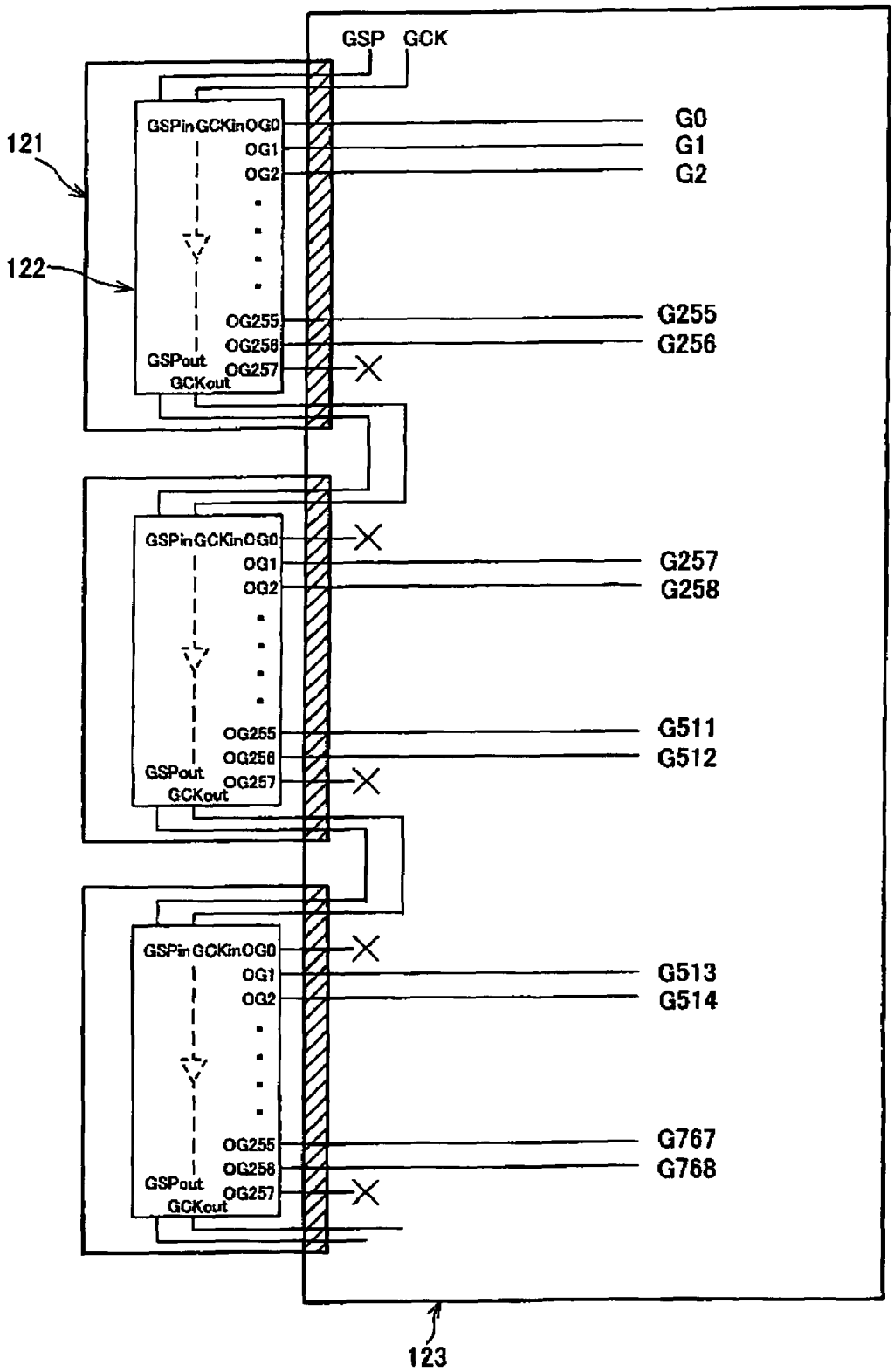
FIG. 25 (PRIOR ART)
FIG. 25 is a plan view of a third arrangement of the gate driver of the conventional liquid crystal display device, and members around the gate driver.

The following will describe still another embodiment of the present invention with reference to FIGS. 15 and 17. By the way, members having the same functions as those described in Embodiments 1-5 are given the same numbers, so that the descriptions are omitted for the sake of convenience.

FIG. 15 illustrates a gate driver 25 and a liquid crystal panel 26 of a liquid crystal display device of the present embodiment. Although not being illustrated, a control IC (control device) includes a line memory for storing image data.

This liquid crystal display device which is a UXGA TFT active matrix type having 1600×1200 pixels includes the gate driver 25 in which driver ICs 25*a*, 25*b*, 25*c*, and 25*d* each having 302 output terminals and being able to produce 300 outputs are cascaded. Since 4 driver ICs are cascaded, 1202 outputs are available. each of the driver ICs is TCP-mounted on a carrier tape 25*e* by a TAB method. The liquid crystal panel 26 includes dummy lines G0 and G1201 which are provided before the first effective pixel and after the last effective pixel, respectively. The dummy lines G0 and G1201 are connected to respective dummy pixels.

Figure 16:
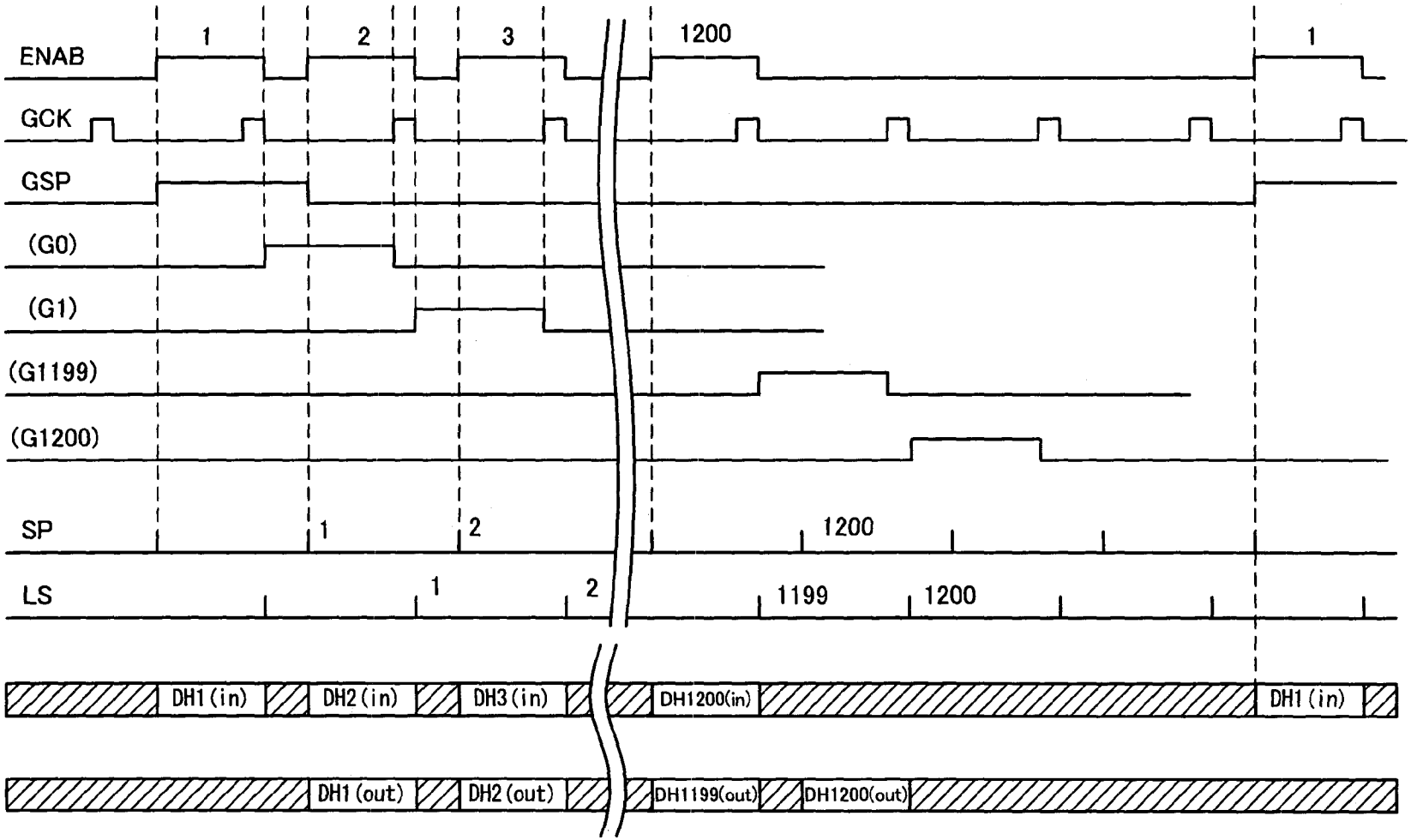
FIG. 16 illustrates timing charts of signals regarding a timing control ASIC of the liquid crystal display device in accordance with Sixth Embodiment of the present invention.

When a very high resolution image format such as UXGA is adopted, the data transfer speed of image data is around 160 MHz so that the data transfer speed of a source drive IC cannot keep up with the data transfer speed of image data quite often. For this reason, a control IC includes a line memory in order to temporarily store sets of image data for one horizontal period. Then the sets of image data are rearranged, and the data transfer speed is slowed in order to allow the source driver IC to be able to sample the image data, and then the sets of data are transferred to the source driver IC. Thus, as illustrated in FIG. 16, a set of image data DH1 (in) of a gate line G0 which is the first line is sampled by the control IC during a first horizontal period (ENAB (1)), and then, as a set of image data DH1 (out), the set of image data is sampled by the source drive IC during a second horizontal period (ENAB(2)). After the finish of the sampling, a latch strobe signal LS is supplied so that the source driver IC outputs an analog signal corresponding to the set of image data DH1 (out).

In accordance with this, as FIG. 16 illustrates, the control IC generates a gate start pulse signal GSP whose pulse length is equivalent to a period from the timing of the input of the ENAB(1) of the data enable signal ENAB to the timing of the input of the ENAB(2) of the data enable signal ENAB. Also, the control IC generates a gate clock signal GCK which is caused to fall at the timing of the end of each ENAB period. With this arrangement, as FIG. 17 illustrates, the gate driver 25 serially outputs gate signals, which have uniform periods, to the dummy line G0 and the gate lines G.

Comparing to Embodiments 1-5, the present embodiment is arranged such that the timing of the input of the display data to the source driver IC is delayed for one horizontal period. For this reason, it is unnecessary to generate the gate start pulse signal GSP and gate clock signal GCK in order to output the gate signal to the dummy line G0 immediately after the data enable signal ENAB of the first line is recognized, as in Embodiment 1. Further, it is also unnecessary to memorize the number of clocks in one horizontal period and delay the timing of driving the liquid crystal, as in Embodiment 4. In the present embodiment, it is possible to drive the dummy line G0 only by delaying the timing that the gate driver 25 obtains the gate start pulse signal GSP supplied from the control IC, for about one horizontal period.

In this manner, according to the present embodiment, the control IC delays the supplied image data for one horizontal period by means of the line memory, and then supplies the delayed image data to the source driver. Thus, it is possible to extend the period from the timing of the input of the data enable signal ENAB to the control IC to the timing that the source driver starts to output the write signals of the first horizontal period of one vertical period. For this reason, it is possible to sufficiently extend the period of driving the dummy line G0, without difficulty.

Embodiments 1-6 have been described as above. The present invention can be applied not only to liquid crystal display devices but also any kinds of matrix display devices in which row lines and column lines are both driven. Further, the output to column lines by a column drive circuit can be carried out by either a line-sequential method or a point-sequential method.

Further, the display device of the present invention may be arranged in such a manner that, the row drive timing signal includes: a start pulse signal which is a pulse shifted in the row drive circuit in order to determine timings to serially output the row drive signals to the respective row lines; and a shift clock signal which determines a timing to shift the start pulse signal, and the control device starts to generate the start pulse signal at the timing of inputting the data enable signal, and generates a first clock of the shift clock signal which allows the row drive circuit to obtain the start pulse signal, in order to cause the first output terminal of the row drive circuit to receive said one of the row drive signals, when a predetermined number of clocks of the clock signal is counted from the timing of inputting.

According to this arrangement, when a drive circuit which serially drive the row lines by shifting the start pulse signal by the shift clock signal is adopted as the row drive circuit, the control device starts to generate the start pulse signal at the timing of inputting the data enable signal. Then the first clock of the shift clock signal is generated when a predetermined number of clocks of the clock signal is counted, and the row drive circuit obtains the start pulse signal in order to drive the dummy row line. This, it is possible to determine the number of the clocks to be counted, in accordance with the setup hold period of the drive ICs adopted to the row drive circuit, and the dummy row line can be driven in accordance with the characteristics of the drive ICs.

Further, the display device of the present invention may be arranged in such a manner that, the control device supplies a column drive start timing signal, which is the column drive timing signal determining timings at which the column drive circuit outputs the column drive signals, to the column drive circuit during a horizontal return period after completion of inputting the display data for one horizontal period to the column drive circuit, and then supplies clocks after the first clock of the shift clock signal to the row drive circuit, in accordance with the column drive start timing signal.

According to this arrangement, the horizontal return period is provided between the pulses of the data enable signal. Instead of outputting the row drive start timing signal at the timing of completing the supply of the display data to the column drive circuit, the control device outputs the row drive start timing signal during the horizontal return period which is after the completion of the supply of the display data to the column drive circuit. Then in accordance with this timing of outputting, the control device supplies the clocks, which are subsequent to the first clock of the shift clock signal, to the row drive circuit.

With this arrangement, it is possible to extend the period of driving the dummy row line when the start pulse signal is obtained at the first clock of the shift clock signal, so that the period of driving the dummy row line is arranged so as to be identical with the drive periods of the remaining row lines.

Further, the display device of the present invention may be arranged in such a manner that, the control device causes the display data, which has been supplied, to be delayed for one horizontal period, and then supplies the display data, which has been delayed, to the column drive circuit.

According to this arrangement, the control device causes the supplied display data to be delayed for one horizontal period, and then supplies the delayed display data to the column drive circuit. With this arrangement, it is possible to extend the period from the timing of inputting the data enable signal to the start of outputting the column drive signals of the first horizontal period of one vertical period, and thus it is possible to sufficiently extend the period of driving the dummy row line, without difficulty.

Further, the display device of the present invention may be arranged in such a manner that, the number of the row lines connected to the pixels effective for displaying is 1050, and the row drive circuit includes 4 driver ICs being cascaded, each of the driver ICs having 263 output terminals for outputting the row drive signals.

According to this arrangement, 1051 lines, i.e. 1050 row lines connected to the pixels effective for displaying and the dummy row line, are driven by cascaded driver ICs having 263×4=1052 output terminals corresponding to the respective lines. Thus, since only a few output terminals are not used for displaying, it is possible to easily realize the downsizing and optimization of the IC chip, and the reduction of costs can be fulfilled as well.

Further, the display device of the present invention may be arranged in such a manner that, the row drive timing signal includes: a start pulse signal which is a pulse shifted in the row drive circuit in order to determine timings to serially output the row drive signals to the respective row lines; and a shift clock signal which determines a timing to shift the start pulse signal, the control device starts to generate the start pulse signal at the timing of inputting the data enable signal to the control device, a first clock of the shift clock signal is generated when a predetermined number of clocks of the clock signal is counted from the timing of inputting, and the row drive circuit obtains the start pulse signal in accordance with the first clock of the shift clock signal, to cause said one of the row drive signals to be outputted to the first output terminal.

Further, the display device of the present invention may further comprises dummy lines each having a dummy pixel, which are provided before a first row line and after a last row line of the display panel, respectively.

Further, the display device of the present invention may comprise: a display panel on which pixels corresponding to respective intersections of row lines and column lines are provided in a matrix manner; a row drive circuit which receives a row drive timing signal for driving the row lines of the display panel, and sequentially supplies row drive signals for driving the row lines to the respective row lines connected to the pixels, in accordance with the row drive timing signal; a column drive circuit which receives display data and a column drive timing signal for driving the column lines of the display panel, and supplies column drive signals corresponding to the display data to the respective column lines connected to the pixels, in accordance with the column drive timing signal; and a control device which receives the display data, a data enable signal, and a clock signal, generates the row drive timing signal from the data enable signal and the clock signal and outputs the row drive timing signal to the row drive circuit, and generates the column drive timing signal from the data enable signal and the clock signal and supplies the column drive timing signal to the column drive circuit, along with the display data, the control device including: a start pulse signal generation section which starts to generate a start pulse signal which is a pulse shifted in the row drive circuit in order to determine timings to serially output the row drive signals, at the timing of inputting the data enable signal to the control device: and a shift clock signal generation section which generates a first clock of a shift clock signal which determines a timing to shift the start pulse signal, when a predetermined number of clocks of the clock signal is counted from the timing of inputting the data enable signal, the row drive circuit obtaining the start pulse signal in accordance with a first clock of the shift clock signal, so as to cause one of the row drive signals to be outputted to a first output terminal.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed:

1. A display device, comprising:

a display panel on which pixels corresponding to respective intersections of row lines and column lines are provided in a matrix manner;

a row drive circuit which receives a row drive timing signal for driving the row lines of the display panel, and sequentially supplies row drive signals for driving the row lines to the respective row lines connected to the pixels, in accordance with the row drive timing signal;

a column drive circuit which receives display data and a column drive timing signal for driving the column lines of the display panel, and supplies column drive signals corresponding to the display data to the respective column lines connected to the pixels, in accordance with the column drive timing signal; and a control device which receives the display data, a data enable signal, and a clock signal, generates the row drive timing signal from the data enable signal and the clock signal and outputs the row drive timing signal to the row drive circuit, and generates the column drive timing signal from the data enable signal and the clock signal and supplies the column drive timing signal to the column drive circuit, along with the display data, wherein:

the control device generates the row drive timing signal with reference to a timing of inputting the data enable signal and supplies the row drive timing signal, which has been generated, to the row drive circuit, so that one of the row drive signals is supplied to a first output terminal of the row drive circuit during a period from the timing of inputting the data enable signal to a start of the column drive circuit outputting the column drive signals of a first horizontal period of one vertical period, and the row drive timing signal includes: a pulse shifted start pulse signal for determining timings to serially output the row drive signals to respective row lines; and a shift clock signal for determining a timing to shift the start pulse signal.

2. The display device as defined in claim 1, wherein the control device starts to generate the start pulse signal at the timing of inputting the data enable signal, and generates a first clock of the shift clock signal which allows the row drive circuit to obtain the start pulse signal, in order to cause the first output terminal of the row drive circuit to receive said one of the row drive signals, when a number of clocks of the clock signal is counted from the timing of inputting.

3. The display device as defined in claim 2, wherein, the control device supplies a column drive start timing signal, which is the column drive timing signal determining timings at which the column drive circuit outputs the column drive signals, to the column drive circuit during a horizontal return period after completion of inputting the display data for one horizontal period to the colunm drive circuit, and then supplies clocks after the first clock of the shift clock signal to the row drive circuit, in accordance with the column drive start timing signal.

4. The display device as defined in claim 2, wherein, the control device inputs clocks, which are after the first clock of the shift clock signal, to the row drive circuit, in order to cause all of the row lines to have an identical drive period.

5. The display device as defined in claim 1, wherein the control device starts to generate the start pulse signal at the timing of inputting the data enable signal to the control device, a first clock of the shift clock signal is generated when a predetermined number of clocks of the clock signal is counted from the timing of inputting, and the row drive circuit obtains the start pulse signal in accordance with the first clock of the shift clock signal, to cause said one of the row drive signals to be outputted to the first output terminal.

6. The display device as defined in claim 1, further comprising dummy lines each having a dummy pixel, which are provided before a first row line and after a last row line of the display panel, respectively.

7. The display device as defined in claim 1, wherein, the control device causes the display data, which has been supplied, to be delayed for said one horizontal period, and then supplies the display data, which has been delayed, to the column drive circuit.

8. The display device as defined in claim 1, wherein, the number of the row lines connected to the pixels effective for displaying is 1050, and the row drive circuit includes 4 driver ICs being cascaded, each of the driver ICs having 263 output terminals for outputting the row drive signals.

9. A display device, comprising:

a display panel on which pixels corresponding to respective intersections of row lines and column lines are provided in a matrix manner;

a row drive circuit which receives a row drive timing signal for driving the row lines of the display panel, and sequentially supplies row drive signals for driving the row lines to the respective row lines connected to the pixels, in accordance with the row drive timing signal;

a column drive circuit which receives display data and a column drive timing signal for driving the column lines of the display panel, and supplies column drive signals corresponding to the display data to the respective column lines connected to the pixels, in accordance with the column drive timing signal; and a control device which receives the display data, a data enable signal, and a clock signal, generates the row drive timing signal from the data enable signal and the clock signal and outputs the row drive timing signal to the row drive circuit, and generates the column drive timing signal from the data enable signal and the clock signal and supplies the column drive timing signal to the column drive circuit, along with the display data, the control device including:

a start pulse signal generation section which starts to generate a start pulse signal which is a pulse shifted in the row drive circuit in order to determine timings to serially output the row drive signals, at the timing of inputting the data enable signal to the control device, and a shift clock signal generation section which generates a first clock of a shift clock signal which determines a timing to shift the start pulse signal, when a predetermined number of clocks of the clock signal is counted from the timing of inputting the data enable signal, wherein the row drive circuit obtains the start pulse signal in accordance with the first clock of the shift clock signal so as to cause one of the row drive signals to be outputted to a first output terminal.

10. A control device of a display drive circuit, wherein, the display drive circuit includes: a row drive circuit which receives a row drive timing signal which is for driving row lines of a display panel on which pixels corresponding to respective intersections of the row lines and column lines are provided in a matrix manner, and serially outputs row drive signals, which are for driving the row lines, to the respective row lines connected to the pixels, in accordance with the row drive timing signal; and a column drive circuit which receives display data and a column drive timing signal which is for driving the column lines of the display panel, and outputs column drive signals, which correspond to the display data, to the respective column lines connected to the pixels, in accordance with the column line drive timing signal, the control device receives the display data, a data enable signal, and a clock signal, generates the row drive timing signal from the data enable signal and the clock signal and supplies the row drive timing signal to the row drive circuit, and generates the column drive timing signal from the data enable signal and supplies the colum drive timing signal to the column drive circuit, along with the display data;

the control device generates the row drive timing signal with reference to a timing of inputting the data enable signal and supplies the row drive timing signal, which has been generated, to the row drive circuit, so that one of the row drive signals is supplied to a first output terminal of the row drive circuit during a period from the timing of inputting the data enable signal to a start of the column drive circuit outputting the column drive signals of a first horizontal period of one vertical period; and the row drive timing signal includes: a pulse shifted start pulse signal for determining timings to serially output the row drive signals to respective row lines; and a shift clock signal for determining a timing to shift the start pulse signal.

11. A driving method of a display device, wherein:

the display device includes: a display panel on which pixels corresponding to respective intersections of row lines and column lines are provided in a matrix manner; a row drive circuit which receives a row drive timing signal for driving the row lines of the display panel, and sequentially supplies row drive signals for driving the row lines to the respective row lines connected to the pixels, in accordance with the row drive timing signal; a column drive circuit which receives display data and a column drive timing signal for driving the column lines of the display panel, and supplies column drive signals corresponding to the display data to the respective column lines connected to the pixels, in accordance with the column drive timing signal; and a control device which receives the display data, a data enable signal, and a clock signal, generates the row drive timing signal from the data enable signal and the clock signal and outputs the row drive timing signal to the row drive circuit, and generates the column drive timing signal from the data enable signal and the clock signal and supplies the column drive timing signal to the column drive circuit, along with the display data, the display data, a data enable signal, and a clock signal are received, the row drive timing signal is generated from the data enable signal and the clock signal and supplied to the row drive circuit, and the column drive timing signal is generated from the data enable signal and the clock signal and supplied to the column drive circuit, along with the display data, and the row drive timing signal is generated with reference to a timing of inputting the data enable signal and supplied to the row drive circuit, so that one of the row drive signals is supplied to a first outnut terminal of the row drive circuit during a period from the timing of inputting the data enable signal to a start of the column drive circuit outputting the column drive signals of a first horizontal period of one vertical period; and the row drive timing signal includes: a pulse shifted start pulse signal for determining timings to serially output the row drive signals to respective row lines; and a shift clock signal for determining a timing to shift the start pulse signal.

* * * * *